US010465337B2

(12) United States Patent
Tanaka et al.

(10) Patent No.: US 10,465,337 B2
(45) Date of Patent: Nov. 5, 2019

(54) ARTIFICIAL LEATHER, ENTANGLED WEB OF FILAMENTS, AND PROCESS FOR PRODUCING THESE

(75) Inventors: Jiro Tanaka, Okayama (JP); Tsuyoshi Yamasaki, Okayama (JP)

(73) Assignee: KURARAY CO., LTD., Kurashiki-shi (JP)

( * ) Notice: Subject to any disclaimer, the term of this patent is extended or adjusted under 35 U.S.C. 154(b) by 1407 days.

(21) Appl. No.: 13/203,582

(22) PCT Filed: Feb. 24, 2010

(86) PCT No.: PCT/JP2010/052899
§ 371 (c)(1),
(2), (4) Date: Oct. 14, 2011

(87) PCT Pub. No.: WO2010/098364
PCT Pub. Date: Sep. 2, 2010

(65) Prior Publication Data

US 2012/0028008 A1 Feb. 2, 2012

(30) Foreign Application Priority Data

Feb. 27, 2009 (JP) ..... 2009-045916
Mar. 31, 2009 (JP) ..... 2009-087339

(51) Int. Cl.
*B32B 5/02* (2006.01)
*B05D 3/00* (2006.01)
(Continued)

(52) U.S. Cl.
CPC .... *D06N 3/0004* (2013.01); *Y10T 428/24942* (2015.01); *Y10T 442/60* (2015.04)

(58) Field of Classification Search
None
See application file for complete search history.

(56) References Cited

U.S. PATENT DOCUMENTS 3,860,472 A * 1/1975 Derville ..... 156/148
2005/0136777 A1* 6/2005 Thomaschefsky et al. .. 442/408
(Continued)

FOREIGN PATENT DOCUMENTS

JP 2005-171430 6/2005
JP 2005-299001 A 10/2005
(Continued)

OTHER PUBLICATIONS

Translation of WO2005124002 as corresponding EP1760177, Yasuda et al. Dec. 2005.*
(Continued)

*Primary Examiner* — Shawn Mckinnon
(74) *Attorney, Agent, or Firm* — Oblon, McClelland, Maier & Neustadt, L.L.P.

(57) ABSTRACT

An artificial leather including a base layer and a surface layer which is formed on one of surfaces of the base layer. The base layer includes bundles of microfine filaments and an elastic polymer. The surface layer includes the microfine filaments or includes the microfine filaments and the elastic polymer. The surface layer satisfies the relationship of $X/Y \geq 1.5$ wherein X is the number of cut ends of the microfine filaments which exist in a region from a surface to a 20 μm depth in a cross section of the artificial leather, Y is the number of cut ends of the microfine filaments which exist in a region from a surface to a 20 μm depth in a cross section perpendicular to the cross section for determining X, and X>Y. The artificial leather having such surface layer exhibits a sufficient gloss without coating a pigment such as metallic powder.

4 Claims, 5 Drawing Sheets

(51) Int. Cl.

| | |
|---|---|
| ***B05D 3/12*** | (2006.01) |
| ***D04H 13/00*** | (2006.01) |
| ***D06N 3/00*** | (2006.01) |

(56) References Cited

U.S. PATENT DOCUMENTS

| | | | |
|---|---|---|---|
| 2009/0053948 | A1 | 2/2009 | Fujisawa et al. |
| 2009/0274862 | A1 | 11/2009 | Nakayama et al. |

FOREIGN PATENT DOCUMENTS

| | | | |
|---|---|---|---|
| JP | 2006 299463 | | 11/2006 |
| JP | 2008-240217 | | 10/2008 |
| JP | 2008 297673 | | 12/2008 |
| JP | 2008 308784 | | 12/2008 |
| WO | WO2005124002 | * | 12/2005 |
| WO | WO2006040992 | * | 4/2006 |
| WO | 2007 040144 | | 4/2007 |
| WO | WO2007040144 | * | 4/2007 |
| WO | 2007 069628 | | 6/2007 |
| WO | WO2007069628 | * | 6/2007 |
| WO | 2009 157063 | | 12/2009 |

OTHER PUBLICATIONS

International Search Report dated Apr. 27, 2010 in PCT/JP10/052899 filed Feb. 24, 2010.

* cited by examiner

ARTIFICIAL LEATHER, ENTANGLED WEB OF FILAMENTS, AND PROCESS FOR PRODUCING THESE

TECHNICAL FIELD

The present invention relates to glossy artificial leathers and a production method thereof and also relates to entangled filament webs comprising microfine fiber-forming filaments. Specifically, the present invention relates to an entangled filament web with little fiber damage due to cutting, which is capable of producing a glossy artificial leather having drapeability with low rebound resilience and high peeling strength. The present invention further relates to an entangled filament web capable of producing a grain-finished artificial leather which forms natural folded wrinkles as in natural leather and a glossy suede-finished artificial leather having a napped surface with comfortable touch and elegant appearance. The present invention still further relates to methods of producing the above artificial leather and entangled filament web.

BACKGROUND ART

Artificial leathers have come to be widely used in clothes, general materials, sport goods, material for bags, etc. because its superiority to natural leathers, such as light weight and easiness of handling, has been accepted by consumers.

Recently, consumer's tastes have been broadened and artificial leathers added with values come to be preferred. For example, consumers need artificial leathers having high quality appearance with gloss. For such artificial leathers, pearl artificial leathers have been known. For example, Patent Document 1 discloses a nubuck artificial leather made of a foamed polyurethane containing metallic powder.

However, the artificial leather proposed in Patent Document 1 loses the gloss during its long use because the metallic powder is merely coated on the surface and therefore easily drops off from the surface.

The method of producing artificial leathers generally used roughly includes a step in which microfine fiber-forming fibers made of two kinds of polymers having different solubility are made into staple fibers, a step in which the staple fibers are formed into a web by using a carding machine, crosslapper, random webber, etc., a step in which the fibers are entangled to one another by a needle-punching, etc. to form an entangled non-woven fabric, a step in which a solution of an elastic polymer such as polyurethane is impregnated into the entangled non-woven fabric, and a step in which the microfine fiber-forming fibers are converted into microfine fibers by removing one of components in the composite fibers.

However, the easy pull-out and drop-off of the staple fibers from the non-woven fabric are inevitable because of their short fiber length. With such drawbacks, the important surface properties, such as the abrasion resistance of the napped surface of suede-finished artificial leather and peeling strength of grain-finished artificial leather, are insufficient. In addition, the resulting product is poor in dense feeling, surface appearance, and quality stability because the fabric is excessively elongated and fibers on the surface are pulled out during its production.

Unlike the production of a staple nonwoven fabric, the production of a filament nonwoven fabric is simple because a series of large apparatuses such as a raw fiber feeder, an apparatus for opening fibers and a carding machine is not needed. In addition, the filament nonwoven fabric is superior to the staple nonwoven fabric in the strength and shape stability. The attempt to use a filament web as the substrate of artificial leather has been made. However, only a grain-finished artificial leather having a substrate which is made of filaments having a normal fineness of 0.5 dtex or more has been on the market. Artificial leathers made of microfine filament have not yet been put on the market. This is because that an entangled web having a stable mass per unit area (a stable weight) is difficult to produce from filaments, the uneven fineness and strain of composite filaments likely cause uneven product quality, and the dense feeling is poor and the hand likely becomes cloth-like because filaments are poor in bulkiness as compared with crimped staples.

To prevent the unevenness and improve the bulkiness, a method of partly relieving the strain by partly cutting filaments so as to densify the web (for example, Patent Document 2). Patent Document 2 describes that the strain markedly caused during the entangling treatment of filaments can be relieved by intentionally cutting the filaments during the entangling treatment by needle punching, thereby exposing the cut ends of filaments to the surface of the nonwoven fabric in a number density of 5 to 100/mm$^2$. The document further describes that 5 to 70 fiber bundles are present per 1 cm width on the cross section parallel to the thickness direction of the nonwoven fabric of filaments, i.e., the number of fiber bundles which are oriented by needle punching in the thickness direction is 5 to 70 per 1 cm width of the cross section. The document further describes that the total area of fiber bundles on a cross section perpendicular to the thickness direction of the nonwoven fabric of filaments is 5 to 70% of the cross-sectional area. Although cutting the filaments to an extent achieving the intended properties, many filaments are required to be cut to make the nonwoven fabric of filaments into the proposed structure. Therefore, the advantages of using filaments that the strength of nonwoven fabric is enhanced because of their continuity are significantly reduced, thereby failing to effectively use their advantages. To cut the fibers on the surface of nonwoven fabric evenly, the filaments should be entangled by repeating the needle punching many times under conditions severer than usual, thereby making it difficult to obtain a nonwoven filament fabric of high quality and high strength aimed in the present invention.

In another proposed method, a filament web with a good flatness, smoothness and hand is obtained by hot-pressing a web of dividable composite filaments (spun-bonded fleece) at high temperature to bond filaments for controlling the shrinkability and then conducting punching treatment first by using needles (No. 1) having a barb depth of 3 to 10 times the fiber diameter and then by using needles (No. 2) having a barb depth of 1 to 6 times the fiber diameter (for example, Patent Document 3). This method is effective for simultaneously conducting the entanglement and the division of fibers while moderately cutting the dividable composite filaments. However, since the filaments are cut, the deterioration of properties of the non-woven fabric is inevitable. In this method, before needle-punching, the spun-bonded fleece is heat-treated by a calendar roll to control the shrinkability of filaments, improve the conveying ability, and control the hand and density of final products. However, since the heat treatment conditions are determined according to the intended shrinkage, it is practically difficult to control the degree of fuse-bonding of filaments on the surface of the spun-bonded fleece, because the dividable filaments have a multi-layered structure of the components having different meting points.

Patent Document 1: JP Patent No. 3056609
Patent Document 2: JP Patent No. 3176592
Patent Document 3: JP 2005-171430A

DISCLOSURE OF INVENTION

An object of the present invention is to provide artificial leathers having a good gloss without coating a pigment such as metallic power and a method of efficiently producing such artificial leathers.

The inventors have considered fully utilizing the characteristic of filaments without intentional cutting and researched on an entangled filament web which can be made into high quality grain-finished artificial leather, semi grain-finished artificial leather, and suede-finished artificial leather. The results showed that the web of microfine fiber-forming filaments just after spinning involved problems in its production, for example, it was difficult to convey the web because filaments were loosely bundles and the bundles were separated into individual filaments when the web was made into a lapped web. In addition, it was difficult to obtain a highly entangled non-woven fabric by needle-punching the microfine fiber-forming filament web because the microfine fiber-forming filaments were non-crimped fibers and therefore the filaments were hardly entangled to each other.

Another object of the invention is to solve the above problems and provide an entangled filament web capable of producing a high quality grain-finished artificial leather, semi grain-finished artificial leather and suede-finished artificial leather and a production method thereof.

As a result of extensive research, the inventors have reached the invention described below to achieve the above objects.

Thus, the present invention relates to an artificial leather comprising a base layer and a surface layer which is formed on one surface of the base layer, wherein the base layer comprises bundles of microfine filaments and an elastic polymer, the surface layer comprises microfine filaments or comprises microfine filaments and the elastic polymer, and the artificial leather satisfies the following requirement:

$$X/Y \geq 1.5$$

wherein X is the number of cut ends of the microfine filaments which exist in a region from a surface to a 20 μm depth in a cross section of the artificial leather, Y is the number of cut ends of the microfine filaments which exist in a region from a surface to a 20 μm depth in a cross section perpendicular to the cross section for determining X, and X>Y.

The present invention further relates to a method of producing artificial leather comprising the following sequential steps:

(1) producing a filament web comprising microfine fiber-forming filaments;
(2) producing an entangled filament web by entangling the filament web; and
(3) producing an entangled non-woven fabric by converting the microfine fiber-forming filaments in the entangled filament web to bundles of microfine filaments; and further comprising the following steps:
(4) impregnating an elastic polymer into the entangled non-woven fabric; and
(5) napping the microfine filaments in the state of bundles on a surface of the entangled non-woven fabric and then ordering the napped microfine filaments, or ordering the bundles on the surface of the entangled non-woven fabric and then napping the microfine filaments in the state of bundles, thereby forming a surface layer which comprises the microfine filaments or comprises the microfine filaments and the elastic polymer and satisfies the following requirement:

$$X/Y \geq 1.5$$

wherein X is the number of cut ends of the microfine filaments which exist in a region from a surface to a 20 μm depth in a cross section of the artificial leather, Y is the number of cut ends of the microfine filaments which exist in a region from a surface to a 20 μm depth in a cross section perpendicular to the cross section for determining X, and X>Y.

As a result of further research, the inventors have found that an entangled filament web achieving the above objects is obtained by temporarily fuse-bonding the filaments on the surface in specific state by hot-pressing the surface of the web of microfine fiber-forming filaments immediately after spinning and then needle-punching the web under controlled conditions to fully entangle the filaments and simultaneously fractionating the temporarily fuse-bonded portions. In more detail, the inventors have found that a highly entangled filament web with little break on filaments is obtained by forming a necessary number of temporarily fuse-bonded points according to the barbs of needle on the surface of filament web before lapping and then entangling the filaments while fractionating the temporarily fuse-bonded points with the progress of the needle punching.

The present invention further relates to an entangled filament web comprising non-crimped microfine fiber-forming filaments which are three-dimensionally entangled and having portions in each of which 2 to 5 microfine fiber-forming filaments are fuse-bonded in a vicinity of surface thereof in a number density of $20/mm^2$ or less.

The present invention still further relates to a method of producing an entangled filament web which comprises the following sequential steps:

(1) producing a filament web comprising non-crimped microfine fiber-forming filaments;
(2) producing a temporary fuse-boned filament web by hot-pressing one or both surfaces of the filament web to temporarily fuse-bonding the microfine fiber-forming filaments in the vicinity of surface; and
(3) subjecting the temporary fuse-bonded filament web to an initial needle punching using needles which have a throat depth of 4 to 20 times a thickness of the microfine fiber-forming filaments in a punching depth of equal to or more than a distance from a tip end of the needles to a first barb at a needle-punching density of 50 to $5000/cm^2$ and then a later needle punching using needles having a throat depth which is 2 to 8 times the thickness of the microfine fiber-forming filaments and thinner than the needles used in the initial needle punching in a punching depth which allows the first barb to reach a depth of 50% or more of a thickness of the temporary fuse-bonded filament web and is smaller than that of the initial needle punching at a needle-punching density of 50 to $5000/cm^2$ while needle-punching by a single or several stages.

According to the present invention, artificial leathers having a good gloss without coating a pigment such as metallic power and a method of efficiently producing such artificial leathers are provided. A highly entangled filament web is obtained because the non-crimped microfine fiber-forming filaments are temporarily fuse-bonded and then entangled. The filament web is easy to convey and handle because it is temporarily fuse-bonded, to improve the production efficiency. In addition, the microfine fiber-forming filaments can be entangled without intentionally cutting fibers. Therefore, the filaments are kept continuous to make the mechanical properties, such as peeling strength, of the entangled filament web and the artificial leather produced therefrom excellent.

BEST MODE FOR CARRYING OUT THE INVENTION

Figure 1:
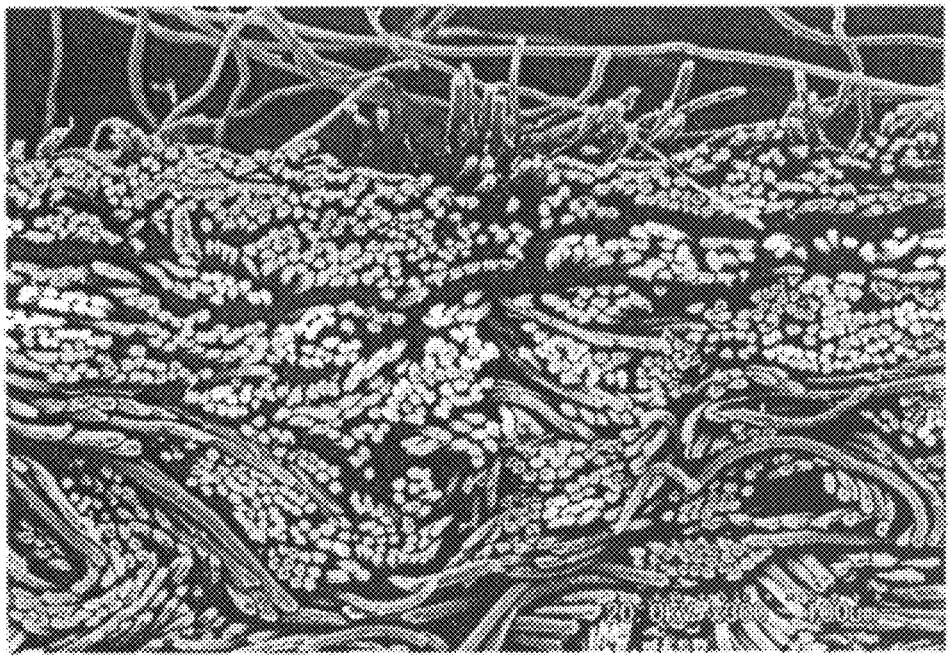
FIG. 1 is a scanning electron microphotograph showing the cross section perpendicular to the machine direction of the artificial leather of Example 1.

The artificial leather of the invention comprises a base layer and a surface layer which is formed on one surface of the base layer. The base layer comprises bundles of microfine filaments and an elastic polymer. The surface layer comprises microfine filaments or comprises microfine filaments and the elastic polymer.

The artificial leather of the invention satisfies the following requirement:

$$X/Y \geq 1.5$$

wherein X is the number of cut ends of the microfine filaments which exist in a region from a surface to a 20 μm depth in a cross section of the artificial leather, Y is the number of cut ends of the microfine filaments which exist in a region from a surface to a 20 μm depth in a cross section of the artificial leather perpendicular to the cross section for determining X, and X>Y.

If X/Y is within the above range, the microfine filaments in the surface layer are partly or wholly oriented in the same direction. The oriented portion reflects the light to give a good gloss.

If less than 1.5, a sufficient metallic gloss is not obtained. Theoretically, the metallic gloss may become higher as the ratio approaches infinity. However, there's almost no change in the metallic gloss when the ratio exceeds 50. Therefore, an excessively high ratio is not preferred in view of production costs, because it merely increases the number of treatment. A ratio of 20 or less is sufficient for practical use. Therefore, X/Y is preferably 1.5 to 50 and more preferably 1.5 to 20.

The ratio is determined, for example, as follows. The surface of artificial leather is hot-pressed at 165° C. under 400 N/cm to fix the orientation of napped fibers in the vicinity of surface. Then, the artificial leather is quickly cut down from its surface by using a single-edged razor without losing the orientation of fibers. After taking a SEM microphotograph of the cross section (for example, 13.5 cm×18 cm microphotograph of 300 magnifications), the number of cut ends of microfine filaments in the region from the surface to a 20 μm depth of artificial leather is counted. Then, the artificial leather is cut down in the direction perpendicular to the previous direction, and the number of cut ends of microfine filaments in the area from the surface of artificial leather to a depth of 20 μm is counted in the same manner. The ratio is calculated from the obtained numbers of cut ends taking the larger number as X and the smaller number as Y The thickness of the surface layer, which comprises the microfine filaments or comprises the microfine filaments and an elastic polymer, and contains substantially no bundle of the microfine filaments, is preferably 5 to 500 μm and more preferably 5 to 200 μm. Within 5 to 500 μm, the surface layer combines a good metallic gloss and an elegant appearance resembling natural leather. The thickness of the base layer is preferably 200 to 4000 μm and more preferably 300 to 2000 μm. Within 200 to 4000 μm, the artificial leather combines a sufficient strength and a soft and dense feeling resembling natural leather.

The method of controlling the ratio and the materials for the artificial leather of the invention, such as microfine filaments, will be described below.

The artificial leather of the invention is produced by the following sequential steps:

(1) producing a filament web comprising microfine fiber-forming filaments;

(2) producing an entangled filament web by entangling the filament web; and (3) producing an entangled non-woven fabric by converting the microfine fiber-forming filaments in the entangled filament web to bundles of microfine filaments; and further comprising the following steps:

(4) impregnating an elastic polymer into the entangled non-woven fabric; and (5) napping the microfine filaments in the state of bundles on a surface of the entangled non-woven fabric and then ordering the napped microfine filaments, or ordering the bundles on the surface of the entangled non-woven fabric and then napping the microfine filaments in the state of bundles, thereby forming a surface layer which comprises the microfine filaments or comprises the microfine filaments and the elastic polymer.

The steps (4) and (5) may follow after the step (3) in this order or in the order of the step (5) and then the step (4).

Each of the steps (1) to (5) when sequentially conducted in this order will be described bellow in detail.

Step (1)

In the step (1), a filament web is produced from non-crimped microfine fiber-forming filaments (sea-island filaments). The sea-island filaments are multi-component composite fibers made of at least two kinds of polymers and have a cross section in which an island component polymer is dispersed in a sea component polymer of different kind. The sea-island filaments are, after formed into an entangled nonwoven fabric and before impregnating an elastic polymer, converted to bundles of microfine filaments made of the island component polymer by removing the sea component polymer by extraction or decomposition.

The island component polymer is selected from known fiber-forming, water-insoluble, thermoplastic polymers. Examples thereof include, but not limited to, polyester resins, such as polyethylene terephthalate (PET), polytrimethylene terephthalate (PTT), polybutylene terephthalate (PBT), polyester elastomers and their modified products; polyamide resins, such as nylon 6, nylon 66, nylon 610, nylon 12, aromatic polyamide, semi-aromatic polyamide, polyamide elastomers and their modified products; polyolefin resins, such as polypropylene; and polyurethane resins such as polyester-based polyurethane. Of these polymers, the polyester resins, such as PET, PTT, PBT, and modified products thereof, are preferred particularly in respect of being easily shrunk upon heating and providing artificial leather products having a hand with dense feeling and good practical performances such as abrasion resistance, fastness to light, and shape retention. The polyamide resins, such as nylon 6 and nylon 66, are hygroscopic as compared with the polyester resins and produce flexible, soft microfine filaments. Therefore, the polyamide resins are preferred particularly in respect of providing artificial leather products having a soft hand with fullness and good practical performances such as antistatic properties.

The island component polymer preferably has a melting point of 160° C. or higher, and more preferably a crystallizable polymer having a melting point of 180 to 330° C. The melting point is measured by the method described below. The island component polymer may be added with colorant, ultraviolet absorber, heat stabilizer, deodorant, fungicidal agent, antimicrobial agent and various stabilizers.

The sea component polymer is removed by extraction with a solvent or decomposition with a decomposer in the step of converting the sea-island filaments to the bundles of microfine filaments. Therefore, the sea component polymer is required to have solubility to solvent or decomposability by decomposer higher than those of the island component polymer. In view of the spinning stability, the sea component polymer is preferably less compatible with the island component polymer and its melt viscosity, its surface tension, or both of them is preferably smaller than those of the island component polymer under the spinning conditions. The sea component polymer is not particularly limited as long as the above preferred requirements are satisfied. Preferred examples include polyethylene, polypropylene, polystyrene, ethylene-propylene copolymer, ethylene-vinyl acetate copolymer, styrene-ethylene copolymer, styrene-acryl copolymer, and polyvinyl alcohol resin. A water-soluble, thermoplastic polyvinyl alcohol (water-soluble PVA) is particularly preferable as the sea component polymer, because grain-finished artificial leather and suede-finished artificial leather are produced without using organic solvents.

The viscosity average polymerization degree (merely referred to as "polymerization degree") of the water-soluble PVA is preferably 200 to 500, more preferably 230 to 470, and still more preferably 250 to 450. If being 200 or more, the melt viscosity is moderate, and the water-soluble PVA is easily made into a composite with the island component polymer. If being 500 or less, the melt viscosity is not excessively high and the extrusion from a spinning nozzle is easy. By using the water-soluble PVA having a polymerization degree of 500 or less, i.e., a low-polymerization degree PVA, the dissolution to a hot water becomes quick. The polymerization degree (P) of the water-soluble PVA is measured according to JIS-K6726, in which the water-soluble PVA is re-saponified and purified, and then, an intrinsic viscosity [η] is measured in water at 30° C. The polymerization degree (P) is calculated from the following equation:

$$P=([\eta]10^3/8.29)^{(1/0.62)}.$$

The saponification degree of the water-soluble PVA is preferably 90 to 99.99 mol %, more preferably 93 to 99.98 mol %, still more preferably 94 to 99.97 mol %, and particularly preferably 96 to 99.96 mol %. If being 90 mol % or more, the melt spinning is performed without causing thermal decomposition and gelation because of a good heat stability and the biodegradability is good. Also, the water solubility is not reduced when modified with a copolymerizable monomer which will be described below, and the conversion to microfine fibers becomes easy. A water-soluble PVA having a saponification degree exceeding 99.99 mol % is difficult to produce stably.

The melting point (Tm) of the water-soluble PVA is preferably 160 to 230° C., more preferably 170 to 227° C., still more preferably 175 to 224° C., and particularly preferably 180 to 220° C. If being 160° C. or higher, the fiber tenacity is prevented from being reduced due to the lowering of crystallizability and the fiber formation is prevented from becoming difficult because of the deteriorated heat stability. If being 230° C. or lower, the sea-island filaments can be stably produced because the melt spinning can be performed at temperatures lower than the decomposition temperature of the water-soluble PVA.

The water-soluble PVA is produced by saponifying a resin mainly constituted by vinyl ester units. Examples of vinyl monomers for the vinyl ester units include vinyl formate, vinyl acetate, vinyl propionate, vinyl valerate, vinyl caprate, vinyl laurate, vinyl stearate, vinyl benzoate, vinyl pivalate and vinyl versatate, with vinyl acetate being preferred in view of easy production of the water-soluble PVA.

The water-soluble PVA may be homo PVA or modified PVA introduced with co-monomer units, with the modified PVA being preferred in view of a good melt spinnability, water solubility and fiber properties. In view of a good copolymerizability, melt spinnability and water solubility of fibers, preferred examples of the co-monomers are α-olefins having 4 or less carbon atoms, such as ethylene, propylene, 1-butene and isobutene; and vinyl ethers, such as methyl vinyl ether, ethyl vinyl ether, n-propyl vinyl ether, isopropyl vinyl ether and n-butyl vinyl ether. The content of the comonomer units derived from α-olefins, vinyl ethers, or both of them is preferably 1 to 20 mol %, more preferably 4 to 15 mol %, and still more preferably 6 to 13 mol % based on the constitutional units of the modified PVA. Particularly preferred is an ethylene-modified PVA, because the fiber properties are enhanced when the comonomer unit is ethylene. The content of the ethylene units is preferably 4 to 15 mol % and more preferably 6 to 13 mol %.

The water-soluble PVA can be produced by a known method such as bulk polymerization, solution polymerization, suspension polymerization, and emulsion polymerization. Preferred are a bulk polymerization and a solution polymerization which are carried out in the absence of solvent or in the presence of a solvent such as alcohol. Examples of the solvent for the solution polymerization include lower alcohols, such as methyl alcohol, ethyl alcohol and propyl alcohol. The copolymerization is performed in the presence of a known initiator, for example, an azo initiator or peroxide initiator such as a, a'-azobisisobutyronitrile, 2,2'-azobis(2,4-dimethyl-varelonitrile), benzoyl peroxide, and n-propyl peroxycarbonate. The polymerization temperature is not critical and a range of from 0 to 150° C. is recommended.

In the known production of artificial leathers, the microfine fiber-forming filaments are cut down to staples with a desired length, and the staples are made into a fiber web. In the present invention, the sea-island filaments (microfine fiber-forming filaments) produced by a spun-bonding method, etc. are made into a filament web without cutting. The sea-island filaments are melt-spun by extruding the sea component polymer and the island component polymer from a composite-spinning spinneret. The spinning temperature (spinneret temperature) is preferably 180 to 350° C. The molten sea-island filaments extruded from the spinneret are cooled by a cooling apparatus, withdrawn to an intended fineness by air jet at a speed corresponding to a take-up speed of 1000 to 6000 m/min using a sucking apparatus, and then collected on a collecting surface, such as a moving net, thereby obtaining a web composed of substantially non-drawn and non-crimped filaments.

In the present invention, the filament web is first produced as mentioned above. By using the filament web, the drawbacks, for example, fiber pull-out in the process of ordering fibers and insufficient orientation of fibers which are involved in the production using staple webs can be eliminated, and the microfine filaments in the surface layer can be partly or wholly oriented in the same direction.

The method of producing the filament web mentioned above is advantageous in productivity, because it does not need a series of large apparatuses such as a raw fiber feeder, an apparatus for opening fibers and a carding machine which are necessarily used in the conventional production method of staple webs. In addition, since the filament web and the artificial leathers made thereof are constituted by filaments with high continuity, the properties thereof, such as strength, are high as compared with those of the staple nonwoven fabric and the artificial leathers made thereof which have been hitherto generally used.

The average cross-sectional area of the sea-island filaments is preferably 30 to 800 $\mu m^2$. The fineness is preferably 1.0 to 20 dtex. The average ratio of the sea component polymer and the island component polymer (corresponding to the volume ratio of the sea component polymer and the island component polymer) in the cross section of the sea-island filaments is preferably 5/95 to 70/30. The number of islands of the sea-island filaments in the cross section is preferably 4 to 1000. The mass per unit area of the filament web is preferably 10 to 2000 $g/m^2$.

In the present invention, the term "filament" means a fiber longer than a staple generally having a length of about 3 to 80 mm and a fiber not intentionally cut as so done in the production of staple. For example, the length of the filaments before converted to microfine filaments is preferably 100 mm or longer, and may be several meters, hundreds of meter, or several kilo-meters as long as being technically possible to produce or being not physically broken.

Step (2)

In the step (2), the filament web is entangled to obtain an entangled filament web. After lapping into layers by a crosslapper if necessary, the filament web is needle-punched simultaneously or alternatively from both surfaces so as to allow one or more barbs to penetrate through the web. The needle-punching density is preferably 300 to 5000/$cm^2$ and more preferably 500 to 3500/$cm^2$. Within the above range, a sufficient entanglement is obtained and the damage of the sea-island filaments by needles is minimized. By the entangling treatment, the sea-island filaments are three-dimensionally entangled to obtain an entangled filament web of closely compacted sea-island filaments, in which the sea-island filaments exist in a number density of 600 to 4000/$mm^2$ in average on a cross section parallel to the thickness direction. The filament web may be added with an oil agent at any stage from its production to the entangling treatment. The entangled filament web may be more densified by a shrinking treatment, for example, by immersing in a hot water at 70 to 150° C. In addition, the sea-island filaments may be more compacted by a hot press so as to stabilize the shape of the filament web. The mass per unit area of the entangled filament web is preferably 100 to 2000 $g/m^2$.

The entangled filament web thus obtained may be more densified by a shrinking treatment, for example, by immersing in a hot water at 70 to 150° C., if necessary. In addition, the microfine fiber-forming filaments may be more compacted by a hot press so as to stabilize the shape of the entangled filament web.

Step (3)

In the step (3), the microfine fiber-forming filaments (sea-island filaments) are micro-fiberized by removing the sea component polymer to produce an entangled nonwoven fabric composed of bundles of microfine filaments. In the present invention, the sea component polymer is preferably removed by treating the entangled filament web with a treating agent which is a non-solvent or non-decomposer for the island component polymer, but a solvent or decomposer for the sea component polymer. If the island component polymer is a polyamide resin or a polyester resin, an organic solvent such as toluene, trichloroethylene and tetrachloroethylene is used when the sea component polymer is polyethylene, a hot water is used when the sea component polymer is the water-soluble PVA, or an alkaline decomposer, such as an aqueous solution of sodium hydroxide, is used when the sea component polymer is an easily alkali-decomposable modified polyester. The removal of the sea component polymer is performed by a method generally used in the field of artificial leather and not particularly limited. In the present invention, the water-soluble PVA is preferably used as the sea component polymer because it is environmentally friend and good for worker's health. The water-soluble PVA is removed without using an organic solvent, for example, by treating with a hot water at 85 to 100° C. for 100 to 600 s (seconds) until 95% by mass or more (inclusive of 100%) of the water-soluble PVA is removed by extraction, thereby converting the microfine fiber forming filaments to the bundles of microfine filaments made of the island component polymer.

If necessary, a shrinking treatment for densification may be performed before or simultaneously with the micro-fiberization of the microfine fiber-forming filaments until the areal shrinkage represented by the following formula:

$$[(\text{area before shrinking treatment} - \text{area after shrinking treatment})/\text{area before shrinking treatment}] \times 100$$

reaches preferably 30% or more and more preferably 30 to 75%. By the shrinking treatment, the shape retention is improved and the fiber pull-out in the napping and ordering processes is prevented.

When conducting the shrinking treatment before the micro-fiberization, the entangled filament web is shrunk preferably in steam atmosphere. The shrinking treatment by steam is preferably conducted, for example, by providing the entangled filament web with water in an amount of 30 to 200% by mass of the sea component, and then, heat-treating in a hot steam atmosphere at a relative humidity of 70% or more, preferably 90% or more and a temperature of 60 to 130° C. for 60 to 600 s. By the shrinking treatment under the above conditions, the sea component polymer plasticized by steam is compressed and deformed by the shrinking force of the filaments made of the island component polymer, thereby facilitating the densification. After the shrinking treatment, the entangled filament web is treated in a hot water at 85 to 100° C., preferably 90 to 100° C. for 100 to 600 s to remove the sea component polymer by dissolution. To remove 95% by mass or more of the sea component polymer, a water jet extraction may be used. The temperature of water jet is preferably 80 to 98° C. The water jet speed is preferably 2 to 100 m/min. The treating time is preferably 1 to 20 min.

The shrinking treatment and the micro-fiberization are simultaneously conducted, for example, by immersing the entangled filament web in a hot water at 65 to 90° C. for 3 to 300 s and successively treating in a hot water at 85 to 100° C., preferably 90 to 100° C. for 100 to 600 s. In the former treatment, the microfine fiber-forming filaments shrink and simultaneously the sea component polymer is compressed. Part of the compressed sea component polymer is eluted from the fibers. Therefore, the voids to be formed by the removal of the sea component polymer are made finer, thereby obtaining an entangled nonwoven fabric more densified.

By the optional shrinking treatment and the removal of the sea component polymer, an entangled nonwoven fabric having a mass per unit area of preferably 140 to 3000 g/m$^2$ and an apparent specific gravity of preferably 0.25 to 0.75 is obtained. The average fineness of the filament bundles in the entangled nonwoven fabric is 0.5 to 10 dtex, preferably 0.7 to 5 dtex. The average fineness of the microfine filaments is 0.001 to 2 dtex, preferably 0.005 to 0.2 dtex. Within the above ranges, the artificial leather more densified is obtained and the nonwoven fabric structure of the surface portion is more densified. The number of microfine filaments in each bundle is not particularly limited as long as the average fineness of the microfine filaments and the average fineness of the bundles are within the above ranges, and generally 5 to 1000 filaments in each bundle.

The wet peel strength of the entangled nonwoven fabric is preferably 4 kg/25 mm or more, more preferably 4 to 20 kg/25 mm, and more preferably 4 to 15 kg/25 mm. The peel strength is a measure of the degree of three-dimensional entanglement of the bundles of microfine filaments. Within the above ranges, the surface abrasion of the entangled nonwoven fabric and the artificial leather to be obtained is small and the shape is well retained. In addition, artificial leather with a good dense feel is obtained. As described below, the entangled nonwoven fabric may be dyed with a disperse dye before providing the elastic polymer. When the wet peel strength is within the above ranges, the pull-out and raveling of fibers during the dyeing operation are prevented.

Step (4)

In the step (4), the entangled nonwoven fabric obtained in the step (3) is provided with an aqueous dispersion or solution of the elastic polymer. The elastic polymer is coagulated under heating to produce the artificial leather. At least one elastomer selected from those conventionally used in the production of artificial leathers is usable as the elastic polymer. Examples thereof include polyurethane elastomer, polyacrylonitrile elastomer, polyolefin elastomer, polyester elastomer, and acrylic elastomer, with polyurethane elastomer and/or acrylic elastomer being particularly preferred.

Known thermoplastic polyurethane is preferably used as the polyurethane elastomer, which is produced by the melt polymerization, bulk polymerization or solution polymerization of a polymer polyol, an organic polyisocyanate and an optional chain extender in a desired ratio.

The polymer polyol is selected from known polymer polyols according to the final use and required properties. Examples thereof include polyether polyols and their copolymers, such as polyethylene glycol, polypropylene glycol, polytetramethylene glycol, and poly(methyltetramethylene glycol); polyester polyols and their copolymers, such as polybutylene adipate diol, polybutylene sebacate diol, polyhexamethylene adipate poly(3-methyl-1,5-pentylene adipate) diol, poly(3-methyl-1,5-pentylene sebacate) diol, and polycaprolactone diol; polycarbonate polyols and their copolymers, such as polyhexamethylene carbonate diol, poly(3-methyl-1,5-pentylene carbonate) diol, polypentamethylene carbonate diol, and polytetramethylene carbonate diol; and polyester carbonate polyols. These polymer polyols may be used alone or in combination of two or more.

The average molecular weight of the polymer polyol is preferably 500 to 3000. The combined use of two or more polymer polyols is preferred because the durability of the resultant grain-finished leather-like sheets such as fastness to light, fastness to heat, resistance to NOx yellowing, resistance to sweat and resistance to hydrolysis are improved.

The organic diisocyanate is selected from known diisocyanates according to the final use and required properties. Examples thereof include an aliphatic or alicyclic diisocyanate each having no aromatic ring (non-yellowing diisocyanate), such as hexamethylene diisocyanate, isophorone diisocyanate, norbornene diisocyanate, and 4,4'-dicyclohexylmethane diisocyanate; and an aromatic diisocyanate, such as phenylene diisocyanate, 2,4-tolylene diisocyanate, 2,6-tolylene diisocyanate, 4,4'-diphenylmethanediisocyanate, and xylylene diisocyanate, with the non-yellowing diisocyanate being preferred because the yellowing by light and heat hardly occurs.

The chain extender is selected according to the final use and required properties from known low-molecular compounds having two active hydrogen atoms which are used as the chain extender in the production of urethane resins. Examples thereof include diamines, such as hydrazine, ethylenediamine, propylenediamine, hexamethylenediamine, nonamethylenediamine, xylylenediamine, isophoronediamine, piperazine and its derivatives, dihydrazide of adipic acid, and dihydrazide of isophthalic acid; triamines, such as diethylenetriamine; tetramines, such as triethylenetetramine; diols, such as ethylene glycol, propylene glycol, 1,4-butanediol, 1,6-hexanediol, 1,4-bis(β-hydroxyethoxy)benzene, and 1,4-cyclohexanediol; toriols, such as trimethylolpropane; pentaols, such as pentapentaerythritol; and amino alcohols, such as aminoethyl alcohol and aminopropyl alcohol. These chain extenders may be used alone or in combination of two or more. Of the above, the combined use of two to four of hydrazine, piperazine, hexamethylenediamine, isophoronediamine and its derivatives, and triamine such as ethylenetriamine is preferred. Since hydrazine and its derivatives has a anti-oxidation effect, the use thereof enhances the durability.

During the chain extending reaction, a monoamine, such as ethylamine, propylamine and butylamine; a carboxyl group-containing amine compound, such as 4-aminobutanoic acid and 6-aminohexanoic acid; or a monool, such as methanol, ethanol, propanol and butanol, may be combinedly used together with the chain extender.

The content of the soft segments (polymer diol) of the thermoplastic polyurethane is preferably 90 to 15% by mass.

Examples of the acrylic elastomer include a water-dispersible or water-soluble polymer of an ethylenically unsaturated monomer, which are composed of a soft component, a crosslinkable component, a hard component and another component which is distinguished from any of the preceding components.

The soft component is derived from a monomer which can form a homopolymer having a glass transition temperature (Tg) of less than −5° C., preferably −90° C. or more and less than −5° C., and is preferably non-crosslinkable (not forming crosslink). Examples of the monomer for constituting the soft component include (meth)acrylic acid derivatives, such as ethyl acrylate, n-butyl acrylate, isobutyl acrylate, isopropyl acrylate, n-hexyl (meth)acrylate, 2-ethylhexyl (meth)acrylate, lauryl (meth)acrylate, stearyl (meth)acrylate, cyclohexyl acrylate, benzyl acrylate, 2-hydroxyethyl acrylate, and 2-hydroxypropyl acrylate. These monomers may be used alone or in combination of two or more.

The hard component is derived from a monomer which can form a homopolymer having a glass transition temperature (Tg) of higher than 50° C., preferably higher than 50° C. and 250° C. or less, and is preferably non-crosslinkable (not forming crosslink). Examples of the monomer for constituting the hard component include (meth)acrylic acid derivatives, such as methyl methacrylate, ethyl methacrylate, isopropyl methacrylate, isobutyl methacrylate, cyclohexyl methacrylate, (meth)acrylic acid, dimethylaminoethyl methacrylate, diethylaminoethyl methacrylate, and 2-hydroxyethyl methacrylate; aromatic vinyl compounds, such as styrene, α-methylstyrene, and p-methylstyrene; acrylamides, such as (meth)acrylamide and diacetone (meth)acrylamide; maleic acid, fumaric acid, itaconic acid and their derivatives; heterocyclic vinyl compounds, such as vinylpyrrolidone; vinyl compounds, such as vinyl chloride, acrylonitrile, vinyl ether, vinyl ketone and vinylamide; and α-olefin, such as ethylene and propylene. These monomers may be used alone or in combination of two or more.

The crosslinkable component is a mono- or multifunctional ethylenically unsaturated monomer unit capable of forming a crosslinked structure or a compound (crosslinking agent) capable of forming a crosslinked structure by the reaction with an ethylenically unsaturated monomer unit in a polymer chain. Examples of the mono- or multifunctional ethylenically unsaturated monomer include di(meth)acrylates, such as ethylene glycol di(meth)acrylate, triethylene glycol di(meth)acrylate, polyethylene glycol di(meth)acrylate, 1,4-butanediol di(meth)acrylate, 1,6-hexanediol di(meth)acrylate, 1,9-nonanediol di(meth)acrylate, neopentyl glycol di(meth)acrylate, dimethylol tricyclodecane di(meth) acrylate, and glycerin di(meth)acrylate; tri(meth)acrylates, such as trimethylol propane tri(meth)acrylate and pentaerythritol tri(meth)acrylate; tetra(meth)acrylates, such as pentaerythritol tetra(meth)acrylate; multifunctional vinyl compounds, such as divinylbenzene and trivinylbenzene; (meth)acrylic unsaturated esters, such as allyl(meth)acrylate and vinyl(meth)acrylate; urethane acrylates having a molecular weight of 1500 or less, such as 2:1 adduct of 2-hydroxy-3-phenoxypropyl acrylate and hexamethylene diisocyanate, 2:1 adduct of pentaerythritol triacrylate and hexamethylene diisocyanate, and 2:1 adduct of glycerin dimethacrylate and tolylene diisocyanate; (meth)acrylic acid derivative having hydroxyl group, such as 2-hydroxyethyl (meth)acrylate and 2-hydroxypropyl(meth)acrylate; acrylamides, such as (meth)acrylamide and diacetone(meth)acrylamide; derivatives thereof, (meth)acrylic acid derivative having epoxy group, such as glycidyl(meth)acrylate; vinyl compounds having carboxyl group, such as (meth)acrylic acid, maleic acid, fumaric acid and itaconic acid; and vinyl compounds having amide group, such as vinylamide. These monomers may be used alone or in combination of two or more.

Examples of the crosslinking agent include oxazoline group-containing compounds, carbodiimide group-containing compounds, epoxy group-containing compounds, hydrazine derivatives, hydrazide derivatives, polyisocyanates, and multifunctional block isocyanates. These compounds may be used alone or in combination of two or more.

Examples of the monomer which constitutes other components of the (meth)acrylic elastic polymer include (meth) acrylic acid derivatives, such as methyl acrylate, n-butyl methacrylate, hydroxypropyl methacrylate, glycidyl(meth) acrylate, dimethylaminoethyl methacrylate, and diethylaminoethyl methacrylate.

The melting point of the elastic polymer is preferably 130 to 240° C. The hot-water swelling at 130° C. is preferably 3% or more, more preferably 5 to 100%, and still more preferably 10 to 100%. Generally, the elastic polymer becomes softer with increasing hot-water swelling, but the intermolecular cohesion becomes weak. Therefore, the elastic polymer falls off in the subsequent production processes or during the use of products, thereby failing to serve as a binder. Within the above range, these drawbacks are avoided. The melting point and hot-water swelling are measured by the method described below.

The peak temperature of the loss elastic modulus of the elastic polymer is preferably 10° C. or lower and more preferably −80° C. to 10° C. If exceeding 10° C., the hand of the artificial leather is hard and the mechanical durability, such as resistance to flexing, is deteriorated. The loss elastic modulus is measured by the method described below.

The elastic polymer is impregnated into the entangled nonwoven fabric in the form of an aqueous solution or dispersion. The content of the elastic polymer in the aqueous solution or dispersion is preferably 0.1 to 60% by mass. The elastic polymer is impregnated to control the hand, retain the shape, prevent the pull-out of naps, and easily separate and orient the bundled microfine fibers in the step (5). Therefore, the impregnation in the state and amount to bind the bundles of microfine filaments tightly is not preferred. In consideration it, the content of the coagulated elastic polymer is preferably 0.5 to 30% by mass, more preferably 1 to 20% by mass, and more preferably 1 to 15% by mass of the microfine filaments. The aqueous solution or dispersion of the elastic polymer may be added with penetrant, defoaming agent, lubricant, water repellent, oil repellent, thickener, bulking agent, curing promoter, antioxidant, ultraviolet absorber, fluorescent agent, anti-mold agent, foaming agent, water-soluble polymer such as polyvinyl alcohol and carboxymethylcellulose, dye, pigment, etc. as long as the properties of resultant artificial leather are not adversely affected.

The aqueous solution or dispersion of the elastic polymer is impregnated into the entangled nonwoven fabric, for example, by dipping to distribute the elastic polymer uniformly inside the entangled nonwoven fabric or by applying on the top and back surfaces, although not particularly limited thereto. In the known production of artificial leathers, the impregnated elastic polymer is prevented from migrating toward the top and back surfaces of the entangled nonwoven fabric by using a heat-sensitive gelling agent, etc., thereby distributing the coagulated elastic polymer uniformly in the entangled nonwoven fabric. However, in the present invention, the pull-out of naps is prevented (binding of filaments) and the bundled microfine filaments are separated and oriented while preventing the hand form being hardened. To achieve these effects which are contradictory to each other, a small amount of the elastic polymer should be effectively used. Therefore, the impregnated elastic polymer is preferably allowed to migrate into the top and back surfaces of the entangled nonwoven fabric and then coagulated, thereby allowing the elastic polymer to be distributed with a nearly continuous gradient along the thickness direction. Namely, in the artificial leather of invention the content of the elastic polymer is preferably large in the vicinity of both surface portions as compared with the central portion in the thickness direction. Therefore, when the artificial leather is divided in the thickness direction to five portions, the content of the elastic polymer in at least one of the outermost portions is preferably 30% by mass or more (solid basis) of the total amount of the elastic polymer. The total amount of the elastic polymer is preferably within the range mentioned above.

To obtain such a distribution gradient, in the present invention the top and back surfaces of the entangled non-woven fabric impregnated with the aqueous solution or dispersion of the elastic polymer is, without preventing the migration, heated preferably at 110 to 150° C. and preferably for 0.5 to 30 min. By such a heating, water transpires from the top and back surfaces to allow the water containing the elastic polymer to migrate toward both the surfaces, and then, the elastic polymer is coagulated in the vicinity of the top and back surfaces. The heating for migration is preferably conducted in a drier by blowing a hot air onto the top and back surfaces.

Step (5)

In the step (5), the microfine filaments in the state of bundles on the surface of the entangled non-woven fabric are napped and the napped microfine filaments are ordered so as to orient in the same direction. Alternatively, the bundles of microfine filaments are ordered so as to orient in the same direction and then the microfine filaments in the state of bundles are napped. In this step, the fiber bundles in the surface portion are converted to the microfine filaments oriented in the same direction, thereby obtaining a surface layer substantially free from the fiber bundles (the fiber bundles are not observed in SEM microphotograph of about 200 magnifications). If the fiber bundles remain in the surface layer not converted to microfine filaments, the gloss is dull. Specifically, by the step (5), the surface layer comprising the microfine filaments or the surface layer comprising the microfine filaments and the elastic polymer, each satisfying the following requirement:

$$X/Y \geq 1.5$$

wherein X is the number of cut ends of the microfine filaments which exist in a region from a surface to a 20 μm depth in a cross section of the artificial leather, Y is the number of cut ends of the microfine filaments which exist in a region from a surface to a 20 μm depth in a cross section perpendicular to the cross section for determining X, and X>Y is formed. The content of the elastic polymer in the surface layer is preferably 9% by mass or less of the total microfine filaments in the artificial leather.

The method of napping the microfine filaments in the fiber bundles and ordering the napped microfine filaments simultaneously is not particularly limited as long as the microfine filaments in the surface layer are finally oriented wholly or partly. For example, card clothing, slant-bristled brush, such as etiquette brush (trademark), and sandpaper are used as the brushing tool. For example, the surface of the entangled non-woven fabric is brushed by a roll wound with a brushing tool. The brushing is preferably conducted by winding up the entangled non-woven fabric at a speed of 3 to 20 m/min while rotating the brushing roll at a speed of 200 to 800 rpm. The roughness of the brushing tool is not particularly limited and preferably 280 to 1200 mesh for sandpaper and the roughness corresponding it for card clothing and slant-bristled brush.

The microfine filaments may be ordered (oriented) in either of the machine direction (MD) and the transverse direction (width direction: TD), preferably in MD in view of production efficiency. For example, if the microfine filaments are ordering in MD, the number of cut ends in the cross section along TD (perpendicular to the orientation) is X and the number of cut ends in the cross section along MD (parallel to the orientation) is Y, and X and Y are reversed if the microfine filaments are oriented in TD.

Before the step (5), a step of surface-treating the entangled non-woven fabric by a surface-treating agent may be conducted. The surface treatment is carried out by coating the entangled non-woven fabric with an aqueous solution or an aqueous dispersion of the surface-treating agent, for example, acrylic resin, urethane resin, fluorine-containing resin and silicon-containing resin. With such surface treatment by the surface-treating agent, the surface friction is increased for efficient napping and ordering in the step (5).

Between the steps (4) and (5) or the steps (3) and (4), the fibers constituting the entangled non-woven fabric may be dyed with a dye selected from known dyes, such as disperse dye and acid dye (metal complex dye), according to the component of the fibers.

For example, fibers constituted by polyester resin is dyed with a disperse dye. Since the dyeing with a disperse dye is conducted under severe conditions (high temperature and high pressure), the microfine fibers may be broken when dyed before providing the elastic polymer (forward dyeing). In the present invention, however, the forward dyeing is applicable because the microfine fibers are filaments. By the shrinking treatment mentioned above, the microfine filaments shrink drastically to obtain the strength well withstanding the dyeing condition with disperse dye. Therefore, it is recommended to conduct the shrinking treatment before the forward dyeing. When the entangled nonwoven fabric containing the elastic polymer is dyed, a reductive washing step under a strong alkaline condition and a neutralizing step are generally required to remove the disperse dye adhered to the elastic polymer so as to improve the color fastness. In the present invention, since the dyeing can be conducted before the step (4) for providing the elastic polymer, these steps can be omitted. The known production method involves the problem that the elastic polymer falls off during the dyeing operation. In the present invention, however, this problem is avoided by the forward dyeing, and therefore, the elastic polymer can be selected from a wide range. After the forward dyeing, the excess dye is removed by washing with a hot water or a solution of neutral detergent. Therefore, the color fastness to rubbing, particularly the wet color fastness to rubbing is improved under extremely mild conditions. In addition, since the elastic polymer is not dyed, the color unevenness attributable to the difference in the color exhaustion between fibers and elastic polymer is prevented.

The disperse dyes having a molecular weight of 200 to 800 which are widely used for dyeing polyester are preferably used in the present invention. Examples thereof include monoazo dyes, disazo dyes, anthraquinone dyes, nitro dyes, naphthoquinone dyes, diphenylamine dyes, and hetero ring dyes. These dyes may be used alone or in combination according to application and intended color. The dyeing concentration varies depending upon the intended color. If dyed in a high concentration exceeding 30% o.w.f. (on the weight of fabric), the wet color fastness to rubbing is reduced. Therefore, the dyeing concentration of 30% o.w.f. or less is preferred. The bath ratio is not critical and preferably 1:30 or less in view of production costs and environmental protection. The dyeing temperature for the dyeing in water or in wet condition is preferably 70 to 130° C. and more preferably 95 to 120° C. The dyeing temperature for the dyeing in dry condition (thermosol dyeing) is preferably 140 to 240° C. and more preferably 160 to 200° C. The dyeing time for the former dyeing is preferably 30 to 90 min, and more preferably 30 to 60 min for light color dyeing and 45 to 90 min for deep color dyeing. The dyeing time for the latter dyeing (thermosol dyeing) is preferably 0.1 to 10 min and more preferably 1 to 5 min. When dyed in a dyeing concentration of 10% o.w.f. or more, the reductive washing may be conducted by using a washing liquid containing a reducing agent in a concentration as low as 3 g/L or less. However, the use of a warm water of 40 to 60° C. with a neutral detergent is preferred.

Examples of the acid dye include series of Kayanol (trademark) and Kayanol Milling of Nippon Kayaku Co., Ltd. and Suminol (trademark) of Sumitomo Chemical Company, Limited. Of the acid dyes, a metal complex dye having coordinated chromium or cobalt in dye molecule is preferred in view of color fastness due to a strong bonding with fibers.

The metal complex dye is a complex salt of azo dye, and 1:1 metal complex dye including one metal which is coordinated to one dye molecule and 1:2 metal complex dye including one metal which is coordinated to two dye molecules are known. The metal is generally chromium. To obtain a higher color fastness, 1:2 metal complex dye is preferably used. The 1:2 metal complex dye is available under Lanyl (trademark) series of Sumitomo Chemical Company, Limited, Kayalan (trademark) series and Kayalax (trademark) series of Nippon Kayaku Co., Ltd., Acidol (trademark) series and Lanafast series of Mitsui BASF Dyes Ltd., Aizen (trademark) series of Hodogaya Chemical Co. Ltd., Isolan (trademark) series of DyStar Textilfarben GmbH, Irgalan (trademark) series of Ciba Specialty Chemicals K.K., and Lanasyn (trademark) series of Clariant International Ltd. Other metal complex dyes are also usable. The dyeing using the metal complex dye is described below.

The dyeing may be conducted under the same dyeing conditions employed in known method of dyeing fibers or fabric with the metal complex dye. For example, the dyeing is conducted under the conditions: a bath ratio of 1:10 to 1:100, a dyeing concentration of 0.0001 to 50% o.w.f., a dyeing temperature of 70 to 100° C., a dyeing time of 20 to 120 min, and a pH of dyeing bath of weakly acidic to neutral. As compared with the dyeing of polyester fibers with a disperse dye, the dyeing with a metal complex dye is easy because it can be carried out under atmospheric pressure and mild conditions.

The dyeing mentioned above may be carried out in the presence of a dyeing aid. Examples of the dyeing aid include a promoter for increasing the dyeing speed, a level dyeing agent for uniform dyeing, a retarding agent for minimizing uneven dyeing by decreasing the dyeing speed, a penetrant for facilitating the penetration or dispersion of dye into fibers, a dye dissolving agent for increasing the solubility of dye to dyeing bath, a dye dispersing agent for increasing the dispersibility of dye in dyeing bath, a fixing agent for enhancing the fastness of absorbed dye, a protecting agent for fibers, and a defoaming agent. The dyeing aid is suitably selected form known chemicals and used in an amount generally employed.

Known dyeing machines, for example, a jet dyeing machine, a wince dyeing machine, a beam dyeing machine, and a jigger dyeing machine, are usable.

The artificial leather of the invention thus produced has a good gloss and combines a low rebound resilience and dense feeling which are comparable to those of natural leather. Therefore, the artificial leather finds a wide application to clothes, shoes, bags, interior furniture, vehicles, gloves, etc.

The steps (1) and (2) for producing the entangled filament web are preferably conducted by the following sequential steps:

(1') producing a filament web comprising non-crimped microfine fiber-forming filaments;

(2') producing a temporary fuse-boned filament web by hot-pressing one or both surfaces of the filament web to temporarily fuse-bonding the microfine fiber-forming filaments in the vicinity of surface; and (3') needle-punching the temporary fuse-bonded filament web by two or more stages under different conditions to fully entangle the microfine fiber-forming filaments and fractionating the temporary fuse-bonded portions simultaneously, thereby producing the entangled filament web.

Since the step (1') is the same as the step (1) mentioned above, the details of the step (1') are omitted here for conciseness.

In the step (2'), the microfine fiber-forming filaments in the vicinity of surface are temporarily fuse-bonded by hot-pressing one or both surfaces of the filament web. The hot press is conducted by passing the filament web between an emboss roll and a back roll preferably at 10 to 90° C., more preferably at 20 to 80° C., and still more preferably at 30 to 59° C. under a line pressure of preferably 5 to 1000 kgf/cm (49 to 9800 N/cm) and more preferably 15 to 200 kgf/cm (735 to 1960 N/cm). If the temperature and pressure are within the above ranges, the microfine fiber-forming filaments in the vicinity of surface are moderately temporarily fuse-bonded and the treated web is easily conveyed and lapped because its shape is stabilized. In addition, the microfine fiber-forming filaments easily move toward the thickness direction by the needle punching in the subsequent step and are fully entangled. Further, the microfine fiber-forming filaments are prevented from being temporarily fuse-bonded at more points than needed. If temporarily fuse-bonded at more points than needed, the microfine fiber-forming filaments are difficult to move by the needle punching, failing to fully entangle the filaments. In addition, the microfine fiber-forming filaments are broken by needles or the needles are broken. Further, many of the temporarily fuse-bonded portions of the microfine fiber-forming filaments remain in the vicinity of surface even when needle-punched under conditions mentioned below, failing to obtain the artificial leather having natural leather-like properties, such as hand, flexibility, dreapability with low rebound resilience, natural folded wrinkle, and elegant appearance. The emboss pattern is not particularly limited and may be lattice pattern, staggered arrangement, staggered semicircle, dot pattern, ellipse pattern, leather pattern, and geometric pattern, with a pattern capable of hot-pressing 5 to 30% of filament web surface being preferred.

In the vicinity of surface of the temporary fuse-bonded filament web thus obtained, the average number of portions in which 6 or more microfine fiber-forming filaments are temporarily fuse-bonded is preferably 10/cm$^2$ or more, more preferably 10 to 100/cm$^2$, still more preferably 15 to 100/cm$^2$, and particularly preferably 20 to 100/cm$^2$. If exceeding 100/cm$^2$, nearly whole surface of the filament web is fuse-bonded and the number of portions in which 2 to 5 microfine fiber-forming filaments are temporarily fuse-bonded in the vicinity of surface of the needle-punched filament web may exceed 20/mm$^2$. By hot-pressing under the above conditions, the degree of temporary fuse-bonding is regulated within the above range. In the present invention, the term "vicinity of surface" means the region in which the microfine fiber-forming filaments are temporarily fuse-bonded by hot press. The thickness of the region varies depending upon the hot-press temperature, line pressure, and fuse-bonding ability of the microfine fiber-forming filaments, and the region generally extends up to a depth of 100 μm from the surface of the temporary fuse-bonded filament web or the entangled filament web. The mass per unit area of the temporary fuse-bonded filament web is preferably 15 to 100 g/m$^2$.

In the step (3'), after lapping the temporary fuse-bonded filament web into layers (preferably two or more layers, more preferably 2 to 40 layers) by using a crosslapper, if necessary, the web is needle-punched simultaneously or alternately from both surfaces to three-dimensionally entangle the microfine fiber-forming filaments. By the needle punching, the number of fuse-bonded microfine fiber-forming filaments is reduced and the temporarily fuse-bonded portions are fractionated, to obtain the entangled filament web for the production of the artificial leather of the invention.

To reduce the number of fuse-bonded fibers, fractionate the temporary fuse-bonded portions, prevent the break of the microfine fiber-forming filaments, fully entangle the microfine fiber-forming filaments, and obtain a high quality surface by preventing uneven needle punching, the needle punching is first carried out by using needles having a large throat depth (S/D: J value) in a deep punching depth (initial needle punching), and then carried out by reducing S/D and/or the punching depth by a single or more stages, preferably 1 to 3 stages (later needle punching).

S/D for the initial needle punching is preferably 4 to 20 times the thickness of the microfine fiber-forming filaments and 60 to 120 μm (J value). The punching depth is preferably larger than the distance between the tip end of needle and the first barb, and the number of barbs which pass through the layered temporary fuse-bonded filament web is preferably 2 to 9. Some of cut-barb type needles have a kick back (K value) of 5 to 50 μm at barb portion. The effective S/D of such needles is taken as J value+K value. The S/D of the later needle punching is preferably smaller than that of the initial needle punching and preferably 2 to 8 times the thickness of the microfine fiber-forming filaments and 20 to 80 μm (J value+K value). The punching depth is preferably equal to or less than that of the initial needle punching for allowing the first barb to reach a depth of 50% or more of the thickness of the temporary fuse-bonded filament web. The number of barbs which pass through the temporary fuse-bonded filament web completely is preferably 0 to 5. If the later needle punching is conducted by two or more stages, it is preferable to use the same S/D and punching depth or gradually reducing one or both of them. Particularly, it is preferable to gradually reduce the punching depth within the range mentioned above.

To fractionate the temporarily fuse-bonded portions without cutting the microfine fiber-forming filaments and fully entangle the filaments without causing needle break, the number of barbs is preferably 1 to 9. It is also preferable to reduce the number of barbs from the initial stage to the final stage of the needle punching. The distance between the tip end of needle and the first barb is preferably 2.1 to 4.2 mm.

To fully entangle the microfine fiber-forming filaments without cutting, the needle-punching density in the initial needle punching is preferably 50 to 5000/cm$^2$ and more preferably 50 to 1000/cm$^2$. To more fully entangle the microfine fiber-forming filaments without cutting and fractionate the temporarily fuse-bonded portions, the needle-punching density in the later needle punching is preferably 50 to 5000/cm$^2$. If the later needle punching is conducted by two or more stages (generally 2 to 3 stages), the punching density may be changed from a high density to a low density. The areal shrinkage after needle punching ([(area before treatment−area after treatment)/area before treatment]×100) is preferably 50 to 120%.

To prevent the turning up of the ends of web in the lapped temporary fuse-bonded filament webs or prevent the slide of the web in the regularly lapped temporary fuse-bonded filament webs, the shape of temporary fuse-bonded filament web may be temporarily fixed before the initial needle punching by the needle punching in a low punching-density of 500/cm$^2$ or less using a swing-type needle punching machine, a usual needle punching machine, or a needle punching machine in which needles passing through the web are received in the brush on the opposite surface of the web. The throat depth of the needles for the temporary fixing may be the same or smaller than that of the needles for the initial needle punching, because it is sufficient to temporarily fix the shape of temporary fuse-bonded filament webs without causing snag, break, or winkle on the surface of lapped temporary fuse-bonded filament webs.

Before or during the needle punching, or before, during or after lapping, the temporary fuse-bonded filament web may be added with an oil agent comprising silicone oil or mineral oil for preventing needle break, preventing the buildup of static electricity, or promoting the entanglement.

By the needle punching under the conditions mentioned above, the number of fuse-bonded fibers in the temporarily fuse-bonded portions in which 6 or more microfine fiber-forming filaments in the vicinity of the surface of temporary fuse-bonded filament web are fuse-bonded to each other is reduced. As a result, the temporarily fuse-bonded portions, in which 2 to 5 microfine fiber-forming filaments in the vicinity of the surface of the resulting entangled filament web are fuse-bonded to each other, exist in a number density of 20/mm$^2$ or less, preferably 0 to 20/mm$^2$, and more preferably 0 to 10/mm$^2$. If exceeding 20/mm$^2$, the napped portion on the surface of resulting suede-finished artificial leather has a hard and rough hand, resulting grain-finished artificial leather has a micro-defect, for example, its grain surface rises from the surface of non-woven fabric. In addition, unnatural wrinkles occur on the grain surface and tiny, natural wrinkles resembling those of natural leather are not obtained. Since the microfine fiber-forming filaments are temporarily fuse-bonded to each other to a moderate degree, the microfine fiber-forming filaments are easily caught by the barbs of needles although the filaments are not crimped, to obtain a sufficient and uniform entanglement.

The entangled filament web thus obtained has a mass per unit area of preferably 200 to 2000 g/m$^2$ and an apparent specific gravity of preferably 0.10 to 0.35. The hot-water areal shrinkage is preferably 25 to 80% when measured by immersing the entangled filament web in a hot water of 50 to 98° C. for 30 to 60 s under a load of 20 gf/g (a load per weight of the non-woven fabric test piece) and then drying. The peeling strength is preferably 2 to 20 kgf/25 mm, more preferably 4 to 20 kgf/25 mm, and most preferably 8 to 20 kgf/25 mm. The average number density of cut ends of the microfine fiber-forming filaments which are exposed to the surface of the entangled filament web is preferably 0 to 30/mm$^2$, more preferably 0 to 20/mm$^2$, and still more preferably less than 10/mm$^2$ (inclusive of zero).

The entangled filament web obtained through the steps (1') to (3') is used for the production of the glossy artificial leather of the invention as well as the grain-finished artificial leather and suede-finished artificial leather as described below.

Although the elastic polymer is preferably impregnated to the microfine entangled filament web, it may be impregnated to the entangled filament web before the conversion to microfine fibers. The elastic polymer to be used is not particularly limited and an elastic polymer having a hot-water weight-swelling ratio at 130° C. of 2 to 50% is preferably used.

The microfine entangled filament web free from the elastic polymer or impregnated with the elastic polymer is used as the substrate of artificial leather.

The grain-finished artificial leather is produced by forming a grain surface on the surface of substrate by a method in which an aqueous solution or aqueous dispersion of an elastic polymer is applied to at least one surface of the substrate and then dried or a method in which an aqueous solution or aqueous dispersion of an elastic polymer is applied to a release paper to form an elastic polymer film and then the film is bonded to the surface of substrate.

When the content of the elastic polymer is in nearly continuously gradient along the thickness direction of the microfine entangled filament web as described above, the grain surface may be formed by hot-pressing the upper and lower surfaces of the microfine entangled filament web at a temperature which is lower than the spinning temperature of the sea-island filaments by 50° C. or more and equal to or lower than the melting point of the elastic polymer. The hot press temperature is preferably 130° C. or higher although not particularly limited thereto as long as the grain surface is formed. The hot press is conducted, for example, by using a heated metal roll under a line pressure of 1 to 1000 N/mm.

The suede-finished artificial leather is obtained by napping at least one surface of the substrate using a known napping treatment, such as buffing, to form a napped surface of the microfine filaments. A softening treatment by crumpling and an ordering treatment, for example, a reverse seal brushing, may be combinedly used, if required. By the above treatments, a surface with metallic gloss is obtained.

The thickness of the artificial leather thus obtained is preferably 0.2 to 3 mm. The entangled filament web of the invention has little fiber damages, such as fiber break, and shows a high peeling strength because it is highly and uniformly entangled. Therefore, the artificial leather produced therefrom has sufficient practical strength, particularly, the grain-finished artificial leather has drapeability with low rebound resilience and natural folded wrinkles and the suede-finished artificial leather has an elegant appearance. The artificial leather of the invention is suitably used in a wide application, such as clothes, shoes, bags, furniture, car seats, gloves, briefcases, and curtains.

EXAMPLES

The present invention will be described with reference to the examples. It should be noted that the scope of the invention is not limited to the examples. The term "part(s)" and "%" used in the examples are based on mass unless otherwise noted. The properties were measured by the following methods.

(1) Average Fineness of Microfine Filaments

The average cross-sectional area of 20 microfine filaments constituting an artificial leather or entangled non-woven fabric was measured under a scanning electron microscope (several hundreds to several thousand of magnifications). The average fineness was calculated from the measured average cross-sectional area and the density of the polymer constituting the fibers.

(2) Average Fineness of Fiber Bundles

The average cross-sectional area of 20 average bundles selected from the bundles constituting an entangled nonwoven fabric was determined from the radius of the circumcircle of the bundle which was measured under a scanning electron microscope (several hundreds to several thousand of magnification). The average fineness of the bundles was calculated from the density of the polymer constituting the fibers while assuming that the average cross-sectional area was filled up with the polymer.

(3) Melting Point

Using a differential scanning calorimeter (TA3000 manufactured by Mettler Toledo International Inc.), a sample was heated to 300 to 350° C. according to the kind of polymer at a temperature rising rate of 10° C./min in nitrogen atmosphere, cooled to room temperature immediately, and then, heated again to 300 to 350° C. at a temperature rising rate of 10° C./min. The peak top temperature of the obtained endothermic peak was taken as the melting point.

(4) Peak Temperature of Loss Elastic Modulus

A film of the elastic polymer having a thickness of 200 μm was heat-treated at 130° C. for 30 min and then subjected to a viscoelastic measurement using an FT Rheospectoler DVE-V4 (Rheology Co.) at a frequency of 11 Hz and a temperature rising speed of 3° C./min to obtain a peak temperature of loss elastic modulus.

(5) Hot-Water Weight-Swelling at 130° C.

A film of the elastic polymer having a thickness of 200 μm was immersed in a hot water at 130° C. for 60 min under pressure, cooled to 50° C., and then taken out by a pair of tweezers. After wiping off the excessive water, the film was weighed. The hot-water weight-swelling ratio is expressed by the ratio of the increased weight to the weight before immersion.

(6) Wet Peel Strength

The surface of a rubber plate of 15 cm long, 2.7 cm wide and 4 mm thick was buffed with a #240 sandpaper to sufficiently roughen the surface. A 100:5 mixed solution of a solvent-type adhesive (US-44) and a crosslinking agent (Desmodur RE) was applied onto both the roughened surface of the rubber plate and one surface of a test piece of 25 cm long (lengthwise direction of a sheet) and 2.5 cm wide in each applied length of 12 cm by using a glass rod. After drying in a dryer at 100° C. for 4 min, the applied surfaces of the rubber plate and test pieces were bonded to each other. After pressing by a press roller and then curing at 20° C. for 24 h, the rubber plate/test piece was immersed in distilled water for 10 min. Each of the rubber plate and the test piece was held at its one end with a chuck, and the rubber plate and the test piece were peeled off at tensile speed of 50 mm/min using a tensile tester. The average wet peel strength was determined from the flat portion of the obtained stress-strain curve (SS curve). The results are shown by the average of three test pieces.

(7) Number of Temporarily Fuse-Bonded Portions

On a scanning electron microphotograph (20 magnifications) of the surface of a temporary fuse-bonded filament web, the number of temporarily fuse-bonded portions in which 6 or more filaments are temporarily fuse-bonded to each other was counted in a rectangular area with a length of 4 mm and a width of 6 mm. The counted number was converted to the number of temporarily fuse-bonded portions per $cm^2$. Similarly, on a scanning electron microphotograph (30 to 50 magnifications) of the surface of an entangled filament web after needle punching, the number of temporarily fuse-bonded portions in which 2 to 5 filaments are temporarily fuse-bonded to each other was counted in a rectangular area with a length of 4 mm and a width of 6 mm. The counted number was converted to the number of temporarily fuse-bonded portions per $mm^2$.

(8) Apparent Specific Gravity

An entangled filament web was cut out into a square with sides of 10 cm and weighed up to hundredth place. Then, the thickness was measured at five points by using a thickness meter under a load of 50 $gf/m^2$ and the measured values were averaged, to calculate the apparent specific gravity ($g/cm^3$).

(9) Number of Cut Ends of Filaments

On a transmission electron microphotograph (50 magnifications) of the surface of entangled filament web, the number of cut ends in each of ten squares with sides of 0.5 mm was counted and the obtained values were averaged to the number of unit area.

Production of Water-Soluble, Thermoplastic Polyvinyl Alcohol Resin

A 100-L pressure reactor equipped with a stirrer, a nitrogen inlet, an ethylene inlet and an initiator inlet was charged with 29.0 kg of vinyl acetate and 31.0 kg of methanol. After raising the temperature to 60° C., the reaction system was purged with nitrogen by bubbling nitrogen for 30 min. Then, ethylene was introduced so as to adjust the pressure of the reactor to 5.9 $kgf/cm^2$. A 2.8 g/L methanol solution of 2,2'-azobis(4-methoxy-2,4-dimethylvaleronitrile) (initiator) was purged with nitrogen by nitrogen gas bubbling. After adjusting the temperature of reactor to 60° C., 170 mL of the initiator solution was added to initiate the polymerization. During the polymerization, the pressure of reactor was maintained at 5.9 $kgf/cm^2$ by introducing ethylene, the polymerization temperature was maintained at 60° C., and the initiator solution was continuously added at a rate of 610 mL/h. When the conversion of polymerization reached 70% after 10 h, the polymerization was terminated by cooling. After releasing ethylene by opening the reactor, ethylene was completely removed by bubbling nitrogen gas.

The non-reacted vinyl acetate monomer was removed under reduced pressure to obtain a methanol solution of ethylene-modified polyvinyl acetate (modified PVAc), which was then diluted to 50% concentration with methanol. To 200 g of the 50% methanol solution of the modified PVAc, 46.5 g of a 10% methanol solution of NaOH was added to carry out a saponification (NaOH/vinyl acetate unit=0.10/1 by mole). After about 2 min of the addition of NaOH, the system was gelated. The gel was crushed by a crusher and allowed to stand at 60° C. for one hour to allow the saponification to further proceed. Then, 1000 g of methyl acetate was added to neutralize the remaining NaOH. After confirming the completion of neutralization by phenolphthalein indicator, white solid was separated by filtration.

The white solid was added with 1000 g of methanol and allowed to stand at room temperature for 3 h for washing. After repeating the above washing operation three times, the solvent was centrifugally removed and the solid remained was dried in a dryer at 70° C. for 2 days to obtain an ethylene-modified polyvinyl alcohol (modified PVA). The saponification degree of the modified PVA was 98.4 mol %. The modified PVA was incinerated and dissolved in an acid for analysis by atomic-absorption spectroscopy. The content of sodium was 0.03 part by mass based on 100 parts by mass of the modified PVA.

After repeating three times the precipitation-dissolution operation in which n-hexane is added to the methanol solution of the modified PVA and acetone is then added for dissolution, the precipitate was vacuum-dried at 80° C. for 3 days to obtain a purified, modified PVAc. The purified, modified PVAc was dissolved in d6-DMSO and analyzed by 500 MHz H-NMR (JEOL GX-500) at 80° C. The content of ethylene unit was 10 mol %. After saponifying the modified PVAc (NaOH/vinyl acetate units=0.5 by mol), the gel was crushed and the saponification was allowed to further proceed by standing at 60° C. for 5 h. The saponification product was extracted by Soxhlet with methanol for 3 days and the obtained extract was vacuum-dried at 80° C. for 3 days to obtain a purified, modified PVA. The average polymerization degree of the purified, modified PVA was 330 when measured by a method of JIS K6726. The content of 1,2-glycol linkage and the content of three consecutive hydroxyl groups in the purified, modified PVA were respectively 1.50 mol % and 83% when measured by 5000 MHz H-NMR (JEOL GX-500). A 5% aqueous solution of the purified, modified PVA was made into a cast film of 10 μm thick, which was then vacuum-dried at 80° C. for one day and then measured for the melting point in the manner described above. The melting point was 206° C.

Example 1

The modified PVA (water-soluble, thermoplastic polyvinyl alcohol resin: sea component) and isophthalic acid-modified polyethylene terephthalate having a modification degree of 6 mol % (island component) were extruded from a spinneret for melt composite spinning (number of island: 25/filament) at 260° C. in a sea component/island component ratio of 25/75 (by mass). The ejector pressure was adjusted such that the spinning speed was 3700 m/min, and bundles of sea-island filaments having an average fineness of 2.1 dtex were collected on a net. Then, the sheet of sea-island filaments on the net was slightly pressed by a metal roll of a surface temperature of 42° C. to prevent the surface from fluffing. Thereafter, the sheet was peeled from the net and hot-pressed between a metal roll (lattice pattern) of a surface temperature of 55° C. and a back roll under a line pressure of 200 N/mm to obtain a filament web having a mass per unit area of 31 $g/m^2$ in which the fibers on the surface were temporarily fuse-bonded in lattice pattern (Step (1)).

After providing an oil agent and an antistatic agent, the filament web was cross-lapped into 8 layers to prepare a lapped web having a total mass per unit area of 250 $g/m^2$, which was then sprayed with an oil agent for preventing needle break. The lapped web was needle-punched in a needle-punching density of 3300/$cm^2$ alternatively from both sides using 6-barb needles with a distance of 3.2 mm from the tip end to the first barb at a punching depth of 8.3 mm (Step (2)). The areal shrinkage by the needle punching was 68% and the mass per unit area of the entangled filament web after the needle punching was 320 $g/m^2$.

The entangled filament web was allowed to areally shrink by immersing it in a hot water at 70° C. for 14 s while winding up it at a line speed of 10 m/min. Then, the entangled filament web was subjected to a dip-nip treatment repeatedly in a hot water at 95° C. to remove the modified PVA by dissolution, to produce an entangled nonwoven fabric composed of three-dimensionally entangled filament bundles each having an average fineness of 2.5 dtex and containing 25 microfine filaments (Step (3)). After drying, the areal shrinkage was 52%, the mass per unit area was 480 g/m$^2$, the apparent density was 0.52 g/cm$^3$, and the peel strength was 4.2 kgf/25 mm.

The entangled non-woven fabric was buffed into a thickness of 0.82 mm. Separately, an aqueous dispersion (solid concentration of 0.4%) was prepared using a polyurethane (elastic polymer having a melting point of 180 to 190° C., a peak temperature of loss elastic modulus of −15° C., and a hot-water weight-swelling ratio at 130° C. of 35%) in which the soft segment was a 70:30 mixture of polyhexylene carbonate diol and polymethylpentene diol and the hard segment was mainly a hydrogenated methylene diisocyanate. The aqueous dispersion was impregnated into the buffed entangled non-woven fabric and then dried, to provide polyurethane in a proportion of 0.2% by mass based on the microfine filaments (0.06% by mass based on the microfine filaments in the surface portion to form the surface layer) (Step (4)). The entangled non-woven fabric was then dyed brown by a disperse dye in a dyeing concentration of 5% o.w.f. The process passing properties (free from pull-out or fray of fibers in the dyeing process and free from pull-out of fibers in the buffing process) were good and the entangled non-woven fabric of the microfine filaments dyed well was obtained.

The surface of the entangled non-woven fabric of the dyed microfine filaments was brushed with a roll wound with a slant-bristled brush at a rotating speed of 400 rpm while winding up the fabric at a speed of 7 m/min, thereby removing the fluffs and ordering the bundles of microfine filaments so as to orient in the machine direction. Then, the surface of the entangled non-woven fabric was buffed with 400-mesh sandpaper rotating at a speed of 400 rpm, thereby raising the bundles of microfine filaments oriented in the machine direction on its surface and simultaneously separating the bundles to individual microfine filaments. Thus, a suede-finished artificial leather with metallic gloss having substantially no bundles of filaments and having ordered microfine filaments not bundled on its outer surface was obtained (Step (5)). The thickness of the surface layer was 70 μm and the thickness of the base layer was 700 μm.

Then, the surface of the obtained suede-finished artificial leather was hot-pressed at 165° C. under 400 N/cm to fix the orientation of napped fibers in the vicinity of surface. The artificial leather was quickly cut down transversely from its surface to the back surface by using a single-edged razor without losing the orientation of fibers. After taking a 13.5 cm×18 cm SEM microphotograph (300 magnifications) of the cross section, the number of cut ends (X) of microfine filaments in the area from the surface to a depth of 20 μm was counted. Then, the artificial leather was cut down in the direction perpendicular to the above direction (direction parallel to MD) and the number of cut ends (Y) was counted in the same manner. X/Y was 3.2.

Figure 2:
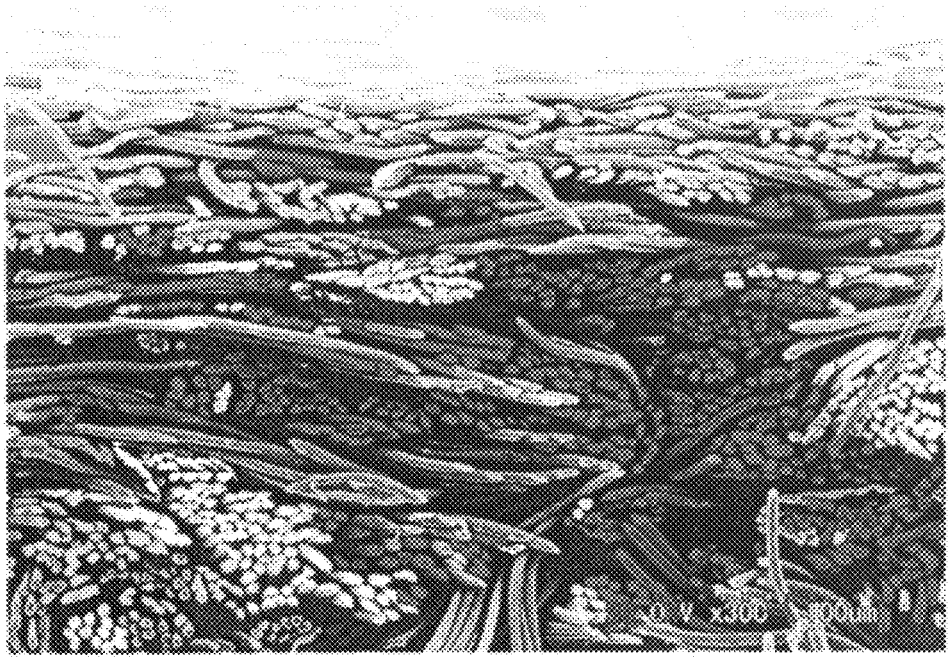
FIG. 2 is a scanning electron microphotograph showing the cross section perpendicular to the transverse direction of the artificial leather of Example 1.

The electron microphotographs (300 magnifications) of the cross section perpendicular to the machine direction and the cross section perpendicular to the transverse direction of the artificial leather are shown in FIGS. 1 and 2, respectively.

Example 2

A suede-finished artificial leather was obtained in the same manner as in Example 1 except for buffing the entangled non-woven fabric with 600-mesh sandpaper at a rotating speed of 600 rpm in place of using 400-mesh sandpaper. The obtained artificial leather had substantially no bundles of filaments on its surface and the microfine filaments on the surface were oriented without being bundled. The surface of the artificial leather had metallic gloss.

X/Y determined in the same manner as in Example 1 was 1.5.

Example 3

A suede-finished artificial leather was obtained in the same manner as in Example 1 except for further treating the entangled non-woven fabric of dyed microfine filaments by immersing it in a 2% aqueous dispersion of a fluorine-containing water repellant (random copolymer of acrylic resin and $C_8F_{15}$ units) as a surface-treating agent, squeezing in a pickup rate of 64%, and then drying at 120° C. for 2 min, thereby allowing the surface-treating agent to remain on the surface. The obtained artificial leather had substantially no bundles of filaments on its surface and the microfine filaments on the surface were oriented without being bundled. The surface of the artificial leather had metallic gloss.

X/Y determined in the same manner as in Example 1 was 20.

Comparative Example 1

Figure 3:
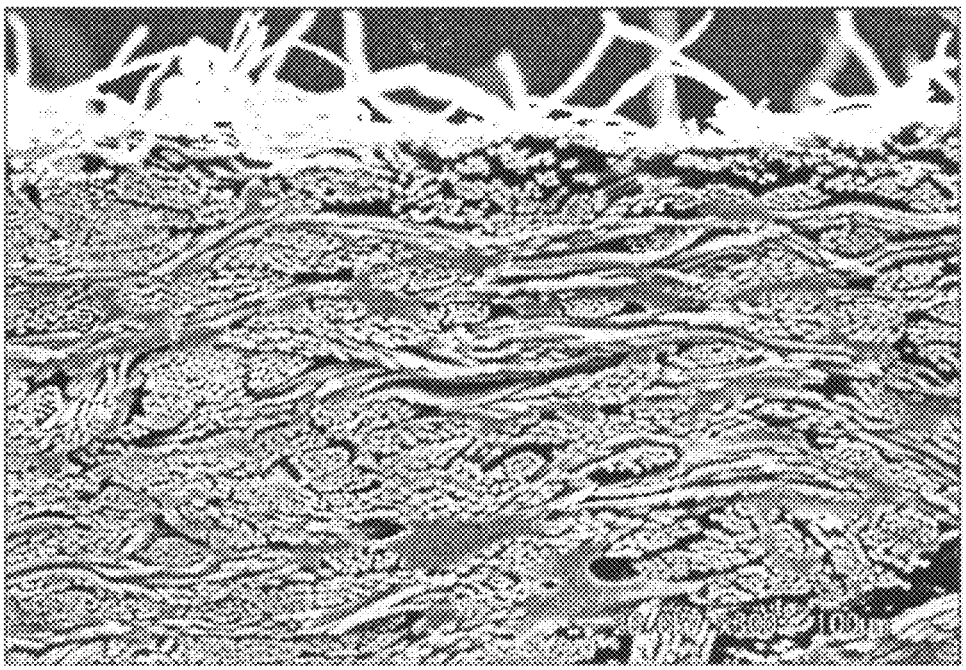
FIG. 3 is a scanning electron microphotograph showing the cross section perpendicular to the machine direction of the artificial leather of Comparative Example 1.
Figure 4:
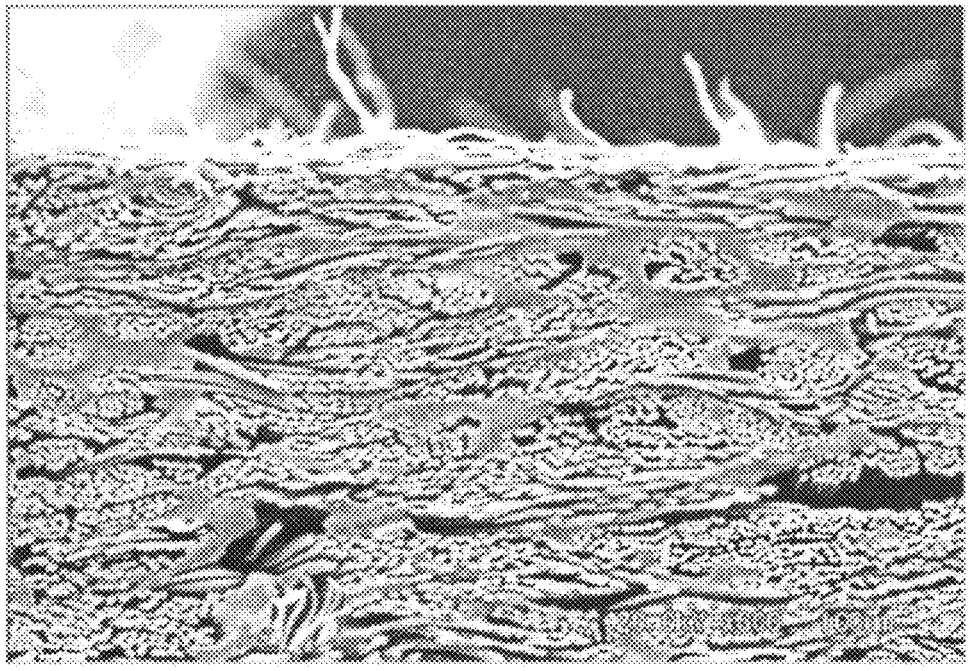
FIG. 4 is a scanning electron microphotograph showing the cross section perpendicular to the transverse direction of the artificial leather of Comparative Example 1.

A suede-finished artificial leather was obtained in the same manner as in Example 1 except for conducting the steps (3) and (4) in the reverse order and using a 50% emulsion to increase the content of impregnated polyurethane to 35%. The thickness of the surface layer was 50 μm and the thickness of the base layer was 800 μm. The bundles of microfine filaments were surrounded by the elastic polymer. Therefore, in the ordering process, only the elastic polymer was scratches and the bundles were not separated into microfine filaments and not oriented in the same direction. X/Y determined in the same manner as in Example 1 was 1.2. The electron microphotographs of the cross section perpendicular to the machine direction and the cross section perpendicular to the transverse direction of the artificial leather are shown in FIGS. 3 and 4, respectively.

The obtained artificial leather had a suede-finished appearance with short-napped fibers (short naps) but showed no metallic gloss.

Comparative Example 2

The sea-island filaments obtained in Example 1 were cut into 25 to 51 mm staples. An entangled non-woven fabric was obtained in the same manner as in Example 1 except for using the staples. The obtained entangled non-woven fabric was impregnated with polyurethane and dyed. The ordering and napping treatments in the same manner as in Example 1 were not successfully done on the dyed entangled non-woven fabric, because the amount of polyurethane in the surface portion was insufficient to cause pull-out of many staples.

To prevent the pull-out of staples, the impregnated amount of polyurethane was increased to 32% by mass (solid basis) of the microfine filaments and the ordering and napping treatments in the same manner as in Example 1 were conducted. However, the amount of polyurethane in the surface portion was excessively large to prevent the microfine fibers from being sufficiently oriented. X/Y was 1.15.

Example 4

Figure 5:
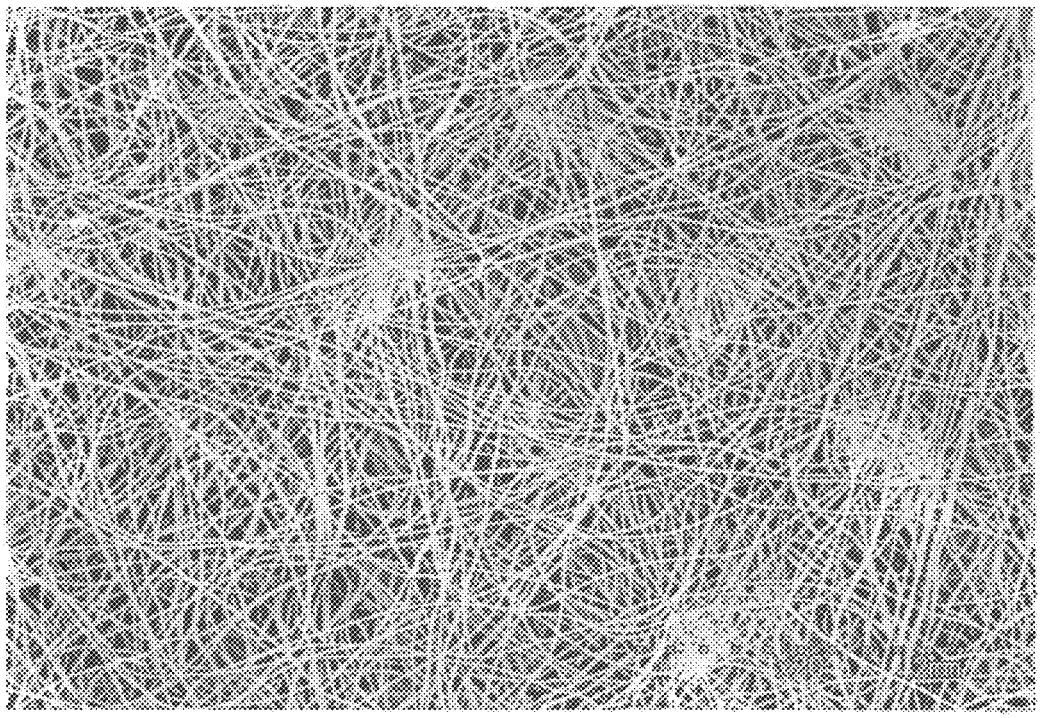
FIG. 5 is a scanning electron microphotograph (×20) showing the vicinity of surface after hot-pressing and before needle-punching of the temporary fuse-bonded filament web of Example 4.

The modified PVA (water-soluble, thermoplastic polyvinyl alcohol resin: sea component) and isophthalic acid-modified polyethylene terephthalate having a modification degree of 6 mol % (island component) were extruded from a spinneret for melt composite spinning (number of island: 25/filament) at 260° C. in a sea component/island component ratio of 25/75 (by mass). The ejector pressure was adjusted such that the spinning speed was 3700 m/min, and non-crimped bundles of sea-island filaments having an average fineness of 2.1 dtex were collected on a net. Then, the sea-island filament web on the net was pressed by a metal roll of a surface temperature of 42° C. under a line pressure of 15 kgf/cm to prevent the surface from fluffing. Thereafter, the web was peeled from the net and hot-pressed between a metal roll (lattice pattern) of a surface temperature of 60° C. and a back roll under a line pressure of 70 kgf/cm to obtain a temporary fuse-bonded filament web having a mass per unit area of 31 g/m$^2$ in which the filaments on the surface were temporarily fuse-bonded in lattice pattern. As seen from FIG. 5, 6 or more sea-island filaments in the vicinity of surface are temporarily fuse-bonded at several portions and the average number density of temporarily fuse-bonded portions was 32/cm$^2$.

Figure 6:
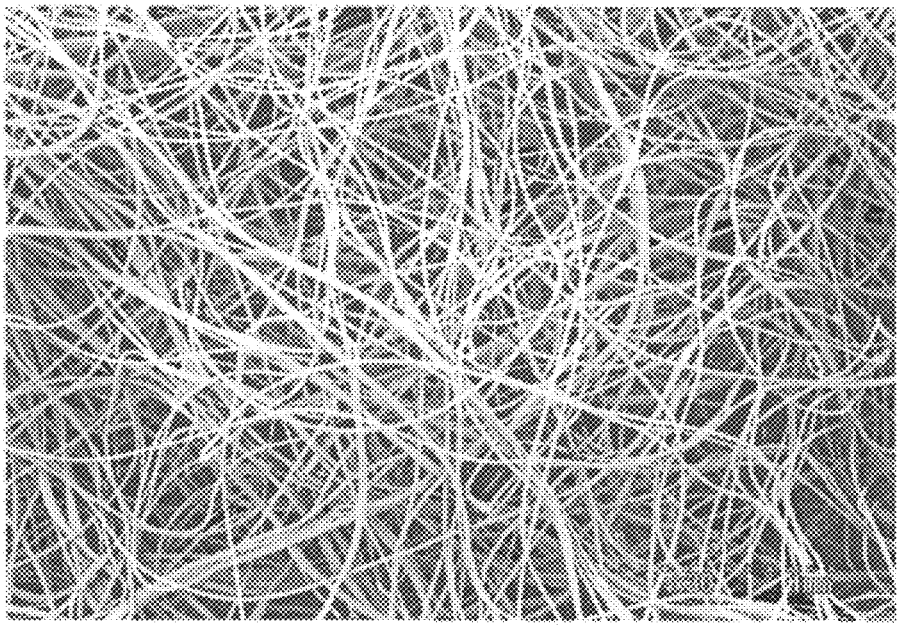
FIG. 6 is a scanning electron microphotograph (×30) showing the vicinity of surface after the initial needle-punching of the temporary fuse-bonded filament web of Example 4.
Figure 7:
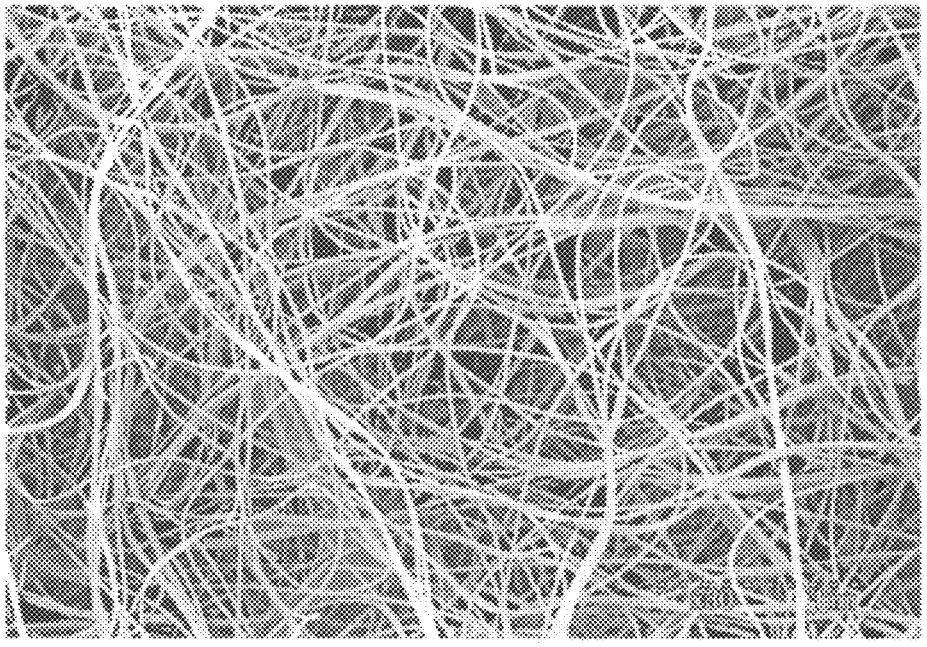
FIG. 7 is a scanning electron microphotograph (×30) showing another vicinity of surface after the initial needle-punching of the temporary fuse-bonded filament web of Example 4.
Figure 8:
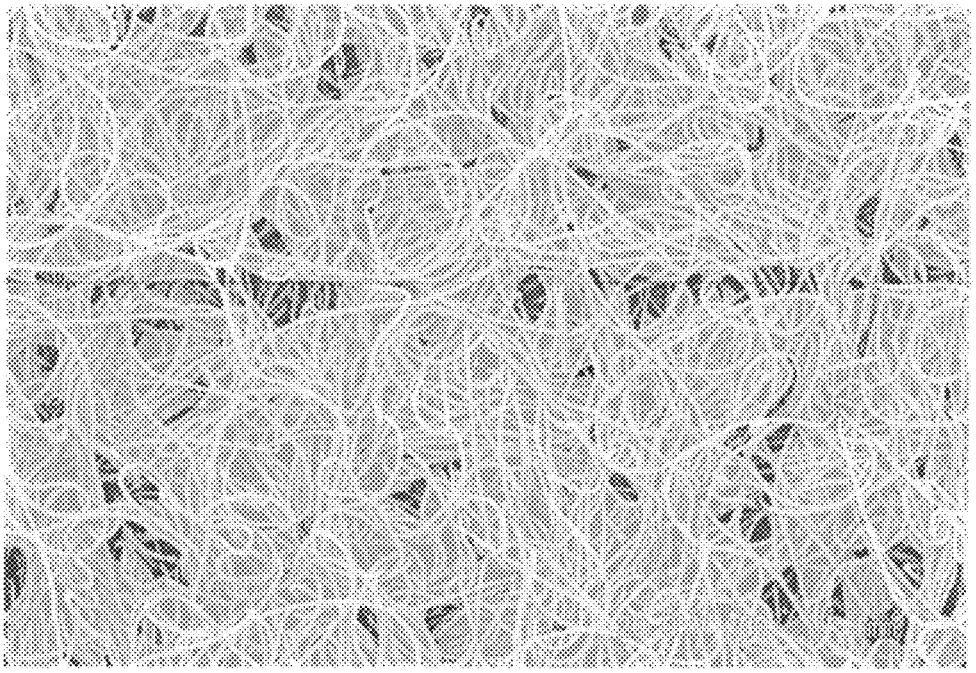
FIG. 8 is a scanning electron microphotograph (×30) showing the vicinity of surface after completing the needle-punching of the temporary fuse-bonded filament web of Example 4.
Figure 9:
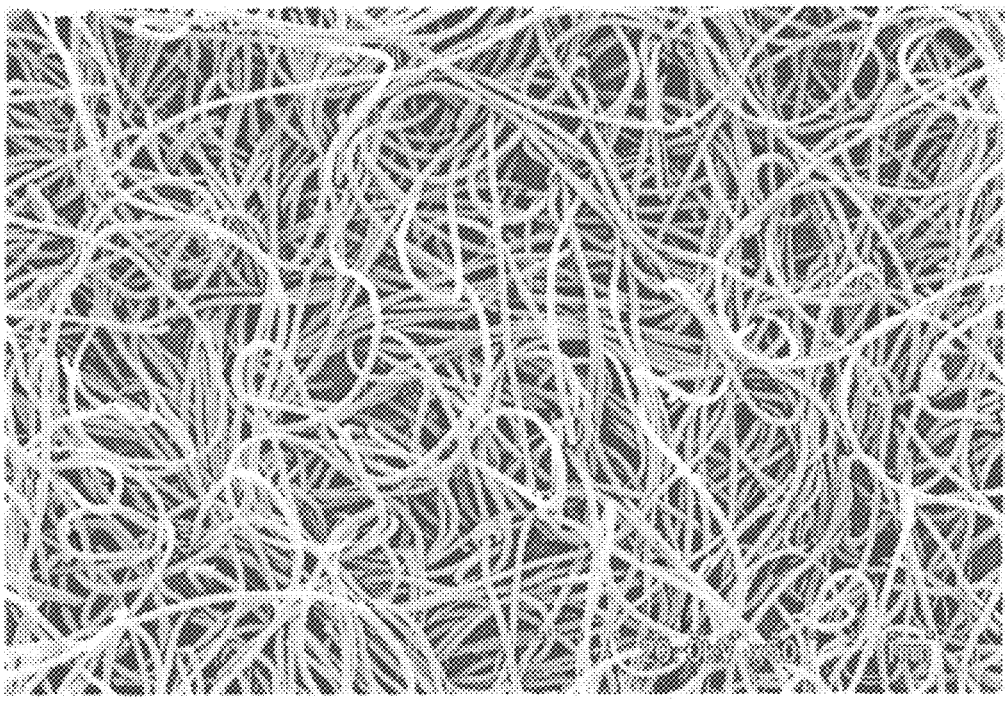
FIG. 9 is a scanning electron microphotograph (×50) showing another vicinity of surface after completing the needle-punching of the temporary fuse-bonded filament web of Example 4.

After providing an oil agent and an antistatic agent, the filament web was cross-lapped into 8 layers to prepare a lapped web having a total mass per unit area of 250 g/m$^2$, which was then sprayed with an oil agent for preventing needle break. Next, the shape of the lapped web was temporarily fixed by a swing-type needle punching machine. Then, the lapped web was needle-punched in a needle-punching density of 450 /cm$^2$ alternatively from both sides using 9-barb needles with a distance of 3.2 mm from the tip end to the first barb and a throat depth of 80 μm at a punching depth of 8.3 mm (initial needle punching). The electron microphotographs of the surface after the initial needle punching are shown in FIGS. 6 and 7. Then, the later needle punching was conducted by three stages: needle-punching in a needle-punching density of 2090/cm$^2$ alternatively from both sides using 6-barb needles with a distance of 3.2 mm from the tip end to the first barb and a throat depth of 60 μm at a punching depth of 8.3 mm; needle-punching in a needle-punching density of 450/cm$^2$ alternatively from both sides at a punching depth of 5.0 mm; and then needle-punching in a needle-punching density of 450/cm$^2$ alternatively from both sides at a punching depth of 2.5 mm, thereby producing an entangled filament web. The areal shrinkage by the needle punching was 68%. The electron microphotographs of the surface of the obtained entangled filament web are shown in FIGS. 8 and 9. FIGS. 8 and 9 show that the sea-island filaments are sufficiently entangled by the needle punching, the temporarily fuse-bonded portions in which 6 or more sea-island filaments are fuse-bonded to each other are fractionated, and the number of temporarily fuse-bonded portions in which 2 to 5 sea-island filaments are fuse-bonded to each other is reduced. A number density of the pilling attributable to fiber cracking due to the needle punching treatment was one or less per 100 m length of the entangled filament web (number of pilling per 100 m in MD of the production line), showing that the process passing properties were good. The properties of the entangled filament web are shown below.

Mass per unit area: 320 g/m$^2$
Apparent specific gravity: 0.18
Number of fuse-bonded portions: 2/mm$^2$
Number of cut ends of filaments: 0/mm$^2$
Peeling strength: 12 kgf/25 mm The obtained entangled filament web was allowed to areally shrink by immersing it in a hot water at 70° C. for 14 s while winding up it at a line speed of 10 m/min. Then, the entangled filament web was subjected to a dip-nip treatment repeatedly in a hot water at 95° C. to remove the modified PVA by dissolution, to produce a microfine entangled filament web composed of three-dimensionally entangled filament bundles each having an average fineness of 2.5 dtex and containing 25 microfine filaments. After drying, the areal shrinkage was 52%. The properties of the obtained microfine entangled filament web are shown below. The results of measurements are shown in Table 1.

Mass per unit area: 480 g/m$^2$
Apparent specific gravity: 0.52
Wet peeling strength: 4.2 kgf/25 mm Example 5

A microfine entangled filament web was obtained in the same manner as in Example 4 except for changing the mass per unit area of the temporary fuse-bonded filament web. The results of measurements are shown in Table 1.

Reference Example 1

A microfine entangled filament web was obtained in the same manner as in Example 4 except for changing the temperature of the metal roll. The results of measurements are shown in Table 1.

Reference Example 2

A microfine entangled filament web was obtained in the same manner as in Example 4 except for changing the mass per unit area of the temporary fuse-bonded filament web, the number of lapped layers, and the temperature of the metal roll. The results of measurements are shown in Table 1.

Reference Example 3

A microfine entangled filament web was obtained in the same manner as in Example 4 except for changing the temperature of the metal roll. The results of measurements are shown in Table 1.

Example 6

A microfine entangled filament web was obtained in the same manner as in Example 4 except for using nylon 6 (NY) as the island component and changing the mass per unit area of the temporary fuse-bonded filament web, the number of lapped layers, and the temperature of the metal roll. The results of measurements are shown in Table 1.

Example 7

A microfine entangled filament web was obtained in the same manner as in Example 4 except for using polypropylene (PP) as the island component and changing the number of lapped layers and the temperature of the metal roll. The results of measurements are shown in Table 1.

TABLE 1

| | Sea-island filaments | | Temporary fuse-bonding | | Temporary fuse-bonded filament web | | Number of temporarily fuse-bonded portions (6 or more fibers) | Number of temporarily fuse-bonded portions (2 to 5 fibers) |
|---|---|---|---|---|---|---|---|---|
| | Sea | Island | Temp. of metal roll (° C.) | Pressure (kgf/cm) | Mass per unit area ($g/m^2$) | Number of lapped layers | Before needle punching (per $cm^2$) | After needle punching (per $mm^2$) |
| Examples | | | | | | | | |
| 4 | PVA | PET | 60 | 70 | 31 | 8 | 32 | 2 |
| 5 | PVA | PET | 60 | 70 | 62 | 8 | 26 | 3 |
| Reference Examples | | | | | | | | |
| 1 | PVA | PET | 140 | 70 | 31 | 8 | 120 | 20 |
| 2 | PVA | PET | 120 | 70 | 300 | 1 | 40 | 15 |
| 3 | PVA | PET | 25 | 70 | 31 | 8 | 8 | A* |
| Examples | | | | | | | | |
| 6 | PVA | NY | 25 | 70 | 35 | 10 | 26 | 6 |
| 7 | PVA | PP | 25 | 70 | 31 | 10 | 32 | 5 |

| | Entangled filament web | | | | | |
|---|---|---|---|---|---|---|
| | Cut ends per $mm^2$ | Mass per unit area $g/m^2$ | Apparent specific gravity | Peeling strength kgf/25 mm | Pilling due to fiber cracking per length of entangled filament web | Dense feeling |
| Examples | | | | | | |
| 4 | 0 | 320 | 0.18 | 12 | one or less per 100 m | good |
| 5 | 0 | 680 | 0.2 | 14 | one or less per 100 m | good |
| Reference Examples | | | | | | |
| 1 | 3 | 200 | 0.11 | 6 | one per 2 m | poor |
| 2 | 12 | 320 | 0.12 | 7 | one per 3 m | poor |
| 3 | | | | A* | | |
| Examples | | | | | | |
| 6 | 0 | 425 | 0.15 | 11 | one or less per 100 m | good |
| 7 | 0 | 432 | 0.16 | 12 | one or less per 100 m | good |

A*: unmeasurable due to difficult conveyance.

Example 8

A suede-finished artificial leather was obtained in the same manner as in Example 1 except for using the entangled filament web obtained in Example 4. The obtained artificial leather had substantially no bundles of filaments on its surface and the microfine filaments on the surface were oriented without being bundled. The surface of the artificial leather had metallic gloss.

X/Y determined in the same manner as in Example 1 was 2.2.

What is claimed is:

1. A method of producing an artificial leather, the method consisting of, sequentially:

(1) producing a filament web comprising at least one microfine fiber-forming filament;

(2) producing an entangled filament web by entangling the filament web;

(3) producing an entangled non-woven fabric by converting the at least one microfine fiber-forming filament in the entangled filament web to bundles of at least one microfine filament;

(4) impregnating an elastic polymer consisting essentially of a polyurethane elastomer into the entangled non-woven fabric; and (5) forming a surface layer by napping the at least one microfine filament in the bundles on a surface of the entangled non-woven fabric to obtain at least one napped microfine filament and then ordering the at least one napped microfine filament, or by ordering the bundles on the surface of the entangled non-woven fabric and then napping the at least one microfine filament in the bundles, such that the artificial leather has metallic gloss producing (1), the producing (2), the producing (3), the impregnating (4), and the forming (5), wherein the napping and the ordering are conducted by brushing the surface of the entangled non-woven fabric with a roll comprising a brushing tool having a roughness corresponding to 280 to 1200 mesh of a sandpaper, thereby winding up the entangled non-woven fabric at a speed of 3 to 20 m/min while rotating the roll at a speed of 200 to 800 rpm, such that the surface layer comprises the at least one microfine filament or comprises the at least one microfine filament and the elastic polymer, that the surface layer is substantially free of bundles of the at least one microfine filament, that the microfine filament in the surface layer is oriented in the same direction, and that the surface layer satisfies an equation:

$$X/Y \geq 1.5$$

where

X is the number of cut ends of the at least one microfine filament in a region from a surface to a 20 μm depth in a first cross section of the artificial leather, Y is the number of cut ends of the at least one microfine filament in a region from a surface to a 20 μm depth in a second cross section perpendicular to the first cross section, and

X>Y.

2. The method of claim 1, wherein the entangled filament web is produced by a process sequentially comprising:

(1') producing a filament web comprising at least one non-crimped microfine fiber-forming filament;

(2') producing a temporary fuse-bonded filament web by hot-pressing one or both surfaces of the filament web to temporarily fuse-bond the at least one microfine fiber-forming filament in the vicinity of surface;

(3') lapping the temporary fuse-bonded filament web into two or more layers;

(4') initial needle punching the temporary fuse bonded filament with at least one first needle having a throat depth of 4 to 20 times a thickness of the at least one microfine fiber-forming filament, where a needle-punching depth is equal to or more than a distance from a tip end of the needles to a first barb, and a needle-punching density is 50 to 5000/cm$^2$; and then (5') later needle punching the temporary fuse bonded filament by a single or several stages with at least one second needle having a throat depth of 2 to 8 times the thickness of the at least one microfine fiber-forming filament and being thinner than the at least one first needle, where the first barb reaches a depth of 50% or more of a thickness of the temporary fuse-bonded filament web, a needle-punching depth is smaller than the needle-punching depth of the initial needle punching, and a needle-punching density is 50 to 5000/cm$^2$.

3. The method of claim 2, wherein the hot pressing is conducted such that a number of temporary fuse-bonded portions in which 6 or more microfine fiber-forming filaments are temporarily bonded to each other is 10/cm$^2$ or more in a vicinity of surface of the temporary fuse-bonded filament web.

4. The method of claim 3, wherein the initial needle punching and the later needle punching are conducted such that a number of temporary fuse-bonded portions in which 2 to 5 microfine fiber-forming filaments are temporarily bonded to each other is 20/mm$^2$ or less in a vicinity of surface of the filament web.

* * * * *